US007396155B2

(12) United States Patent
Oguchi

(10) Patent No.: US 7,396,155 B2
(45) Date of Patent: Jul. 8, 2008

(54) ELECTRONIC TIMEPIECE WITH RADIO COMMUNICATION FUNCTION

(75) Inventor: Isao Oguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/457,439

(22) Filed: Jul. 13, 2006

(65) Prior Publication Data

US 2006/0250896 A1 Nov. 9, 2006

Related U.S. Application Data

(63) Continuation of application No. 10/840,574, filed on May 6, 2004.

(30) Foreign Application Priority Data

May 9, 2003 (JP) ..... 2003-132144

(51) Int. Cl.
*G04B 37/00* (2006.01)

(52) U.S. Cl. ..... 368/298; 368/309

(58) Field of Classification Search ..... 368/47, 368/283, 204, 205, 309, 297, 298
See application file for complete search history.

(56) References Cited

U.S. PATENT DOCUMENTS

| | | | | |
|---|---|---|---|---|
| 5,331,608 | A * | 7/1994 | Umemoto et al. | 368/10 |
| 6,134,188 | A | 10/2000 | Ganter et al. | |
| 6,205,091 | B1 | 3/2001 | Rudolph et al. | |
| 6,356,512 | B1 | 3/2002 | Martin et al. | |
| 6,411,569 | B1 | 6/2002 | Megner et al. | |
| 6,542,120 | B1 * | 4/2003 | Gilbertson | 342/419 |
| 6,967,903 | B2 * | 11/2005 | Guanter | 368/224 |
| 7,126,880 | B2 | 10/2006 | Motokawa et al. | |
| 7,136,138 | B1 * | 11/2006 | Sekiguchi et al. | 349/162 |
| 2002/0071346 | A1 | 6/2002 | Paratte et al. | |
| 2003/0117900 | A1 | 6/2003 | Fujisawa et al. | |
| 2004/0004909 | A1 | 1/2004 | Fujimori | |
| 2004/0042344 | A1 | 3/2004 | Motokawa et al. | |
| 2004/0145975 | A1 | 7/2004 | Barras et al. | |

FOREIGN PATENT DOCUMENTS

| | | | |
|---|---|---|---|
| DE | 29607866 | U1 | 8/1997 |
| DE | 20211848 | U1 | 10/2002 |
| EP | 0935178 | A2 | 8/1999 |
| EP | 1067442 | A2 | 1/2001 |

(Continued)

OTHER PUBLICATIONS

Nikkei Business Daily, Mar. 7, 2003, p. 24.

*Primary Examiner*—Paula A. Bradley
*Assistant Examiner*—Jeanne-Marguerite Goodwin
(74) *Attorney, Agent, or Firm*—Michael T. Gabrik; Mark P. Watson

(57) ABSTRACT

An antenna is positioned relative to one or more other components within a metal or alloy case member/back cover assembly of an electronic timepiece having a radio communication function to facilitate reception of radio waves by the antenna, and/or to reduce negative effects on the signal reception ability of the antenna caused by one or more other components. Thus positioning the antenna improves its reception, while the external appearance of the timepiece can be maintained or enhanced by using metal or alloy for the case member/back cover assembly.

42 Claims, 25 Drawing Sheets

FOREIGN PATENT DOCUMENTS

| | | | | |
|---|---|---|---|---|
| EP | 1286234 | A1 | | 2/2003 |
| EP | 1455249 | A2 | | 9/2004 |
| JP | 55091237 | | | 7/1980 |
| JP | 58028683 | A | * | 2/1983 |
| JP | 11160464 | | | 6/1999 |
| JP | 11223684 | | | 8/1999 |
| JP | 2601225 | | | 9/1999 |
| JP | 2000286761 | | | 10/2000 |
| JP | 2001033571 | | | 2/2001 |
| JP | 2001264463 | | | 9/2001 |
| JP | 2001264467 | | | 9/2001 |
| JP | 2001305244 | | | 10/2001 |
| JP | 2002031690 | | | 1/2002 |
| JP | 2002107469 | | | 4/2002 |
| JP | 2002293644 | | | 10/2002 |
| JP | 2002341058 | | | 11/2002 |
| JP | 2002341059 | | | 11/2002 |
| JP | 200350983 | | | 2/2003 |
| JP | 2003050983 | | | 2/2003 |
| JP | 2003121569 | | | 4/2003 |
| JP | 2003139869 | | | 5/2003 |
| JP | 2004104551 | | | 4/2004 |
| WO | WO03003130 | | | 1/2003 |

* cited by examiner

ELECTRONIC TIMEPIECE WITH RADIO COMMUNICATION FUNCTION

CONTINUING APPLICATION DATA

This application is a continuation of, and claims priority under 35 U.S.C. § 120 to U.S. application Ser. No. 10/840,574, filed May 6, 2004, the content of which is incorporated by reference herein in its entirety.

BACKGROUND OF THE INVENTION

1. Field of the Invention

The present invention relates an electronic timepiece with a radio communication function such as a radio-controlled timepiece, and relates more particularly to an electronic timepiece with a radio communication function having an antenna positioned within the timepiece relative to one or more other components to facilitate reception of radio waves by the antenna.

2. Description of the Related Art

Radio-controlled timepieces having an antenna to receive a radio signal containing standard time information and adjust the time based on the received time signal are one type of electronic timepiece with a radio communication function for receiving radio frequency (RF) signals from external sources and transmitting RF signals to external devices. Radio-controlled timepieces that have the antenna disposed externally to the case so that the antenna can easily receive RF signals have been proposed (see, for example, Japanese Unexamined Patent Appl. Pub. H11-223684, FIG. 4). This radio-controlled timepiece can receive RF signals with good reception by means of the antenna even if the case member is metal without the metal case interfering with RF signal reception. However, locating the antenna externally to the case detracts from the appearance of the radio-controlled timepiece.

Some radio-controlled timepieces also have solar power generating means, thermal power generating means, or other electrical generating means assembled with the movement of the timepiece, and use the generated output of such generating means to drive the timepiece (see, for example, Japanese Unexamined Patent Appl. Pub. 2003-121569, FIG. 1). However, while the antenna is disposed in the movement and the arrangement of the generating means and antenna are shown in the figures for the radio-controlled timepiece of this patent application, the location of the movement relative to the case is not described. As a result, there could be interference with signal reception by the antenna if, for example, the case is metal, and poor signal reception could result in some situations.

Radio-controlled timepieces having the antenna housed inside the case have also been proposed (see, for example, Japanese Unexamined Patent Appl. Pub. 2002-31690, FIG. 6). The solar cell circuit board in this radio-controlled timepiece is located inside the movement at a position covering the antenna. However, because the solar cell circuit board is usually made from stainless steel or other metal, the circuit board can interfere with signal reception.

A radio-controlled timepiece in which the dial is made from ceramic or other non-metallic material has also been proposed (see, for example, Japanese Unexamined Patent Appl. Pub. 2003-139869, FIG. 1). The back cover or case member of this radio-controlled timepiece, however, must be made from ceramic in order to lower the possibility of interference with signal reception, thus detracting from the appearance of the radio-controlled timepiece. If the back cover or case member is made of metal in order to improve the appearance, signals cannot be received with good reception because the antenna is surrounded by the back cover and case member.

SUMMARY OF THE INVENTION

An object of the present invention is therefore to provide an electronic timepiece having a metal or alloy case member/back cover assembly and a radio communication function that includes an antenna positioned within the assembly relative to one or more other components to facilitate radio signal reception.

According to one aspect of the invention, an electronic timepiece having a radio communication function is provided. Such electronic timepiece comprises a case member, and a back cover integrated with, or attached to, the case member, the case member and the back cover made of metal or alloy, the case member with which the back cover has been integrated or to which the back cover has been attached defining an interior and having an open end; an antenna housed in the interior; a time display unit configured to display the time and housed in the interior; and a movement housed in the interior, the movement including an electromagnetic motor configured to drive the time display unit. Moreover, with respect to an axial direction extending between the open end and the back cover, a distance between a center of the antenna and the open end is less than a distance between a center of the electromagnetic motor and the open end.

The center of the antenna is preferably the center of the antenna core, in which case the core is made of metal or alloy. Alternatively, or additionally, the center of the electromagnetic motor is preferably the center of a coil of the electromagnetic motor.

With respect to axial direction extending between the open end and the back cover, (i) a distance between the center of the antenna and the time display unit is less than a distance between a center of the movement and the time display unit, (ii) a distance between the center of the electromagnetic motor and the back cover is less than a distance between a center of the movement and the back cover, and/or (iii) a center of the movement is positioned between the center of the antenna and the center of the electromagnetic motor.

In one embodiment, the time display unit includes a dial made of a nonconductive and nonmagnetic material. In such embodiment, the electronic timepiece described above preferably further comprises a photoelectric generator that is disposed on, or proximally to, a side of the dial facing in a direction of the back cover.

In another aspect of the invention, an electronic timepiece having a radio communication function comprises a case member, and a back cover integrated with, or attached to, the case member, the case member and the back cover made of metal or alloy, the case member with which the back cover has been integrated or to which the back cover has been attached defining an interior and having an open end; an antenna housed in the interior, the antenna including a core made of high permeability material and a coil; and a time display unit configured to display the time and housed in the interior. With respect to an axial direction extending between the open end and the back cover, a distance between a center point of at least one continuous end surface segment of the core of the antenna and the time display unit is less than a distance between a center of the coil and a time display unit.

In one embodiment, the coil of the antenna is wound around the core and at least one end of the antenna is bent toward the time display unit.

In one embodiment, the time display unit includes a dial made of a nonconductive and nonmagnetic material. In such embodiment, the electronic timepiece described above preferably further comprises a photoelectric generator that is disposed on, or proximally to, a side of the dial facing in a direction of the back cover.

In one embodiment, the electronic timepiece described above includes a movement housed in the interior, the movement including an electromagnetic motor configured to drive the time display unit. In such embodiment, with respect to axial direction extending between the open end and the back cover, a distance between the center of the antenna and the time display unit is less than a distance between a center of the electromagnetic motor and the time display unit.

In another aspect of the invention, an electronic timepiece having a radio communication function comprises a case member, and a back cover integrated with, or attached to, the case member, the case member and the back cover made of metal or alloy, the case member with which the back cover has been integrated or to which the back cover has been attached defining an interior and having an open end; an antenna housed in the interior; a photoelectric generator disposed in the interior, the photoelectric generator having a support substrate made of a nonconductive and nonmagnetic material and a photoelectric conversion element that is supported on, or proximally to, the support substrate to receive light, the photoelectric conversion element being configured to generate electricity from the received light; a time display unit configured to display the time; and a drive unit configured to drive the time display unit using electricity generated by the photoelectric generator. The antenna is disposed on or under the photoelectric generator or proximally thereto between the photoelectric generator and the back cover, with an axis of the antenna being substantially parallel to the plane of the support substrate, such that the antenna is in a position overlapping the support substrate as seen in a plan view of the electronic timepiece.

In still another aspect of the invention, an electronic an electronic timepiece having a radio communication function comprises a case member, and a back cover integrated with, or attached to, the case member, the case member and the back cover made of metal or alloy, the case member with which the back cover has been integrated or to which the back cover has been attached defining an interior and having an open end; an antenna housed in the interior, the antenna having two ends; a photoelectric generator disposed in the interior, the photoelectric generator having a support substrate and a photoelectric conversion element that is supported on, or proximally to, the support substrate to receive light, the photoelectric conversion element being configured to generate electricity from the received light; a time display unit configured to display the time; and a drive unit configured to drive the time display unit using electricity generated by the photoelectric generator. The antenna is disposed on or under the photoelectric generator or proximally thereto between the photoelectric generator and the back cover, with an axis of the antenna being substantially parallel to the plane of the support substrate, with at least both ends of the antenna in positions not overlapping the support substrate as seen in a plan view of the electronic timepiece.

One or more of the following additional features may be embodied in either of the above-described aspects: the antenna is disposed between the photoelectric generator and the back cover at a specified distance from the photoelectric generator; the antenna and the photoelectric generator are disposed such that at least portions thereof overlap as seen in a side view of the electronic timepiece; a dial of the time display unit is disposed between the photoelectric generator and a cover member that covers the open end of the case member, in which case both the cover member and the dial are made of a nonconductive and nonmagnetic material; no other component of the electronic timepiece is disposed between the antenna and the photoelectric generator as seen in a side view of the electronic timepiece; no other component of the electronic timepiece is disposed between the antenna and a dial of the time display unit as seen in a side view of the electronic time piece; at least one other component of the electronic timepiece is disposed between the antenna and the back cover as seen in a side view of the electronic timepiece; a center of a core of the antenna is positioned on the open end side of a center of the movement in a height direction extending between the open end and the back cover; and/or a date wheel made of a nonconductive and nonmagnetic material is provided, which has a back cover side that faces in the direction of the back cover, in which case the antenna is disposed proximally to the back cover side between the back cover side and the back cover and overlaps the date wheel as seen in a plan view of the electronic timepiece.

In any of the above-described aspects and embodiments thereof, the outer surface of the case member and/or the back cover preferably comprises molded synthetic resin that is coated with a thin film that is metallic or has metallic properties. Such construction further improves the appearance of the electronic timepiece with radio communication function.

As the above descriptions indicate, the invention provides various arrangements for positioning the antenna relative to one or more other components within a metal or alloy case member/back cover assembly of the electronic timepiece to facilitate reception of radio waves by the antenna, and/or to reduce negative effects on the signal reception ability of the antenna caused by one or more other components. Thus positioning the antenna improves its reception, while the external appearance of the timepiece can be maintained or enhanced by using metal or alloy for the case member/back cover assembly.

In embodiments having a support substrate made of nonconductive and nonmagnetic material, a radio signal, e.g., the standard time signal can travel through without interference from the support substrate. The antenna can therefore send and receive radio signals even when the support substrate is disposed between the antenna and the incoming radio signals. Being able to more freely position the antenna inside the case member while still maintaining good transmission and reception performance, enables improvements to the external appearance of the electronic timepiece to be made without sacrificing performance. For example, the back cover and case member can be made of metal.

In some embodiments, the antenna is positioned so that it does not interfere with light reception by the photoelectric conversion unit from the open end of the case member, thereby preventing a drop in photoelectric conversion efficiency. In some arrangements, the photoelectric conversion unit can occupy a relatively large area inside the case member, also preventing a drop in photoelectric conversion efficiency.

In one embodiment, no other component of the electronic timepiece with a radio communication function is disposed between the antenna and the photoelectric generator as seen in a side view of the electronic timepiece. With such an arrangement, the antenna can be easily located in closer proximity to the photoelectric generator.

In one embodiment, one or more other components of the electronic timepiece with a radio communication function are disposed between the antenna and back cover as seen in a side view of the electronic timepiece. Preferably, the antenna and such other component(s) are located in overlapping positions as seen in a plan view of the electronic timepiece with a radio communication function. In such an arrangement, the antenna can be more easily disposed further from the back cover and thus closer to the open end of the case member. Radio communication with good, reliable reception by the antenna is thus possible through the open end. Note that these other components include, for example, the gears in the gear train for driving the hands, and a switch for driving the gear train manually, when the electronic timepiece with a radio communication function is an analog watch with hands.

Rendering the antenna with its axis substantially parallel to the plane of the support substrate means herein that the angle between the direction of the antenna axis and the plane of the support substrate is greater than or equal to 0° and less than or equal to 30°, and is preferably less than or equal to 15°, and even further preferably less than or equal to 10°.

A plan view of the electronic timepiece means viewing the electronic timepiece from the direction parallel to the axial direction of the case member. A side view of the electronic timepiece means viewing the electronic timepiece with a radio communication function from a direction perpendicular to the axial direction of the case member.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings like reference symbols refer to like parts.

DESCRIPTION OF THE PREFERRED EMBODIMENTS

Figure 1:
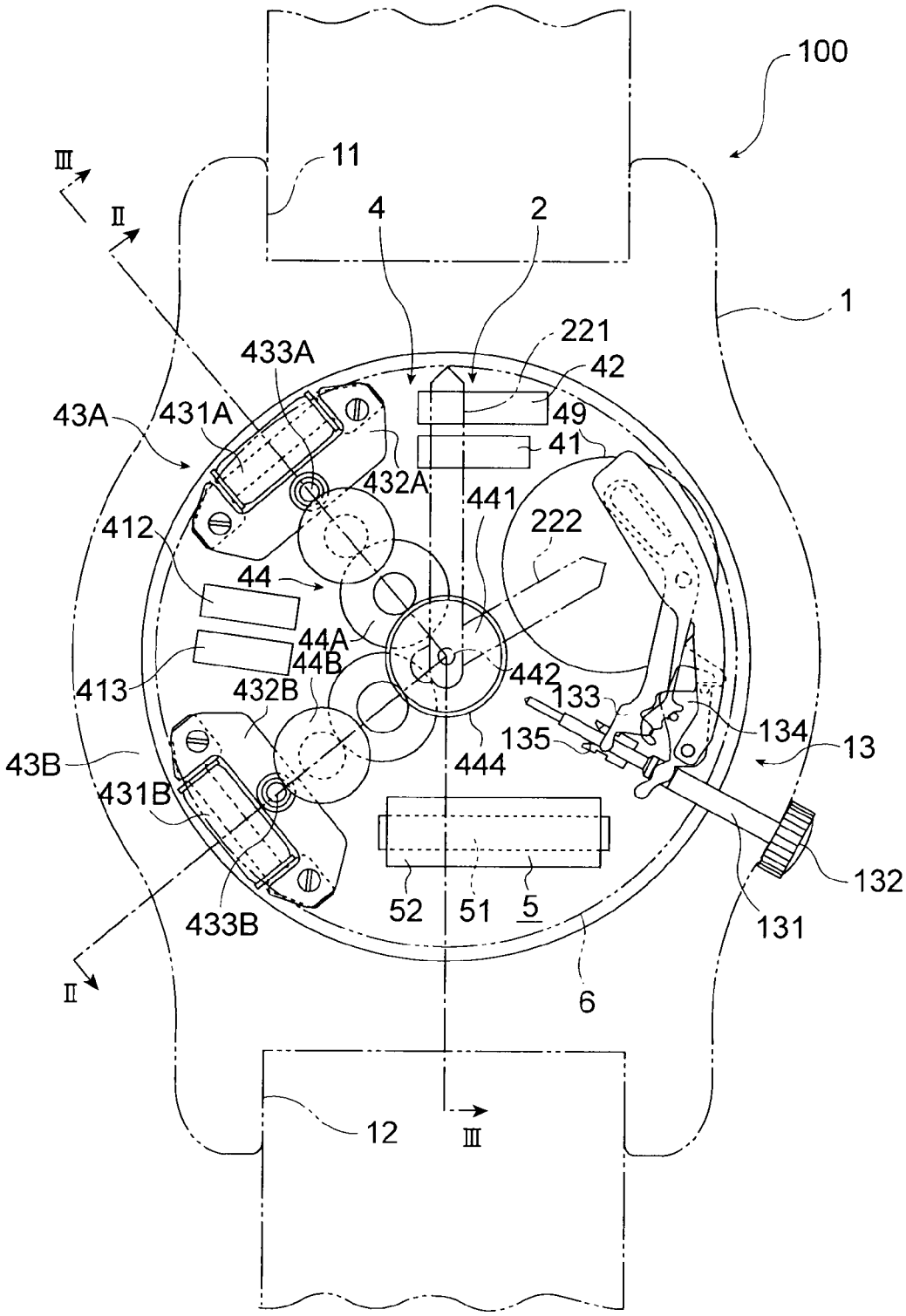
FIG. 1 is a plan view of a radio-controlled timepiece according to a first embodiment of the present invention.

Preferred embodiments of the present invention are described below with reference to the accompanying figures. Note that parts in the second and subsequent embodiments that are identical to or have the same function as corresponding parts in the first embodiment are identified by the same reference numeral, and further description thereof is simplified or omitted.

First Embodiment

Figure 2:
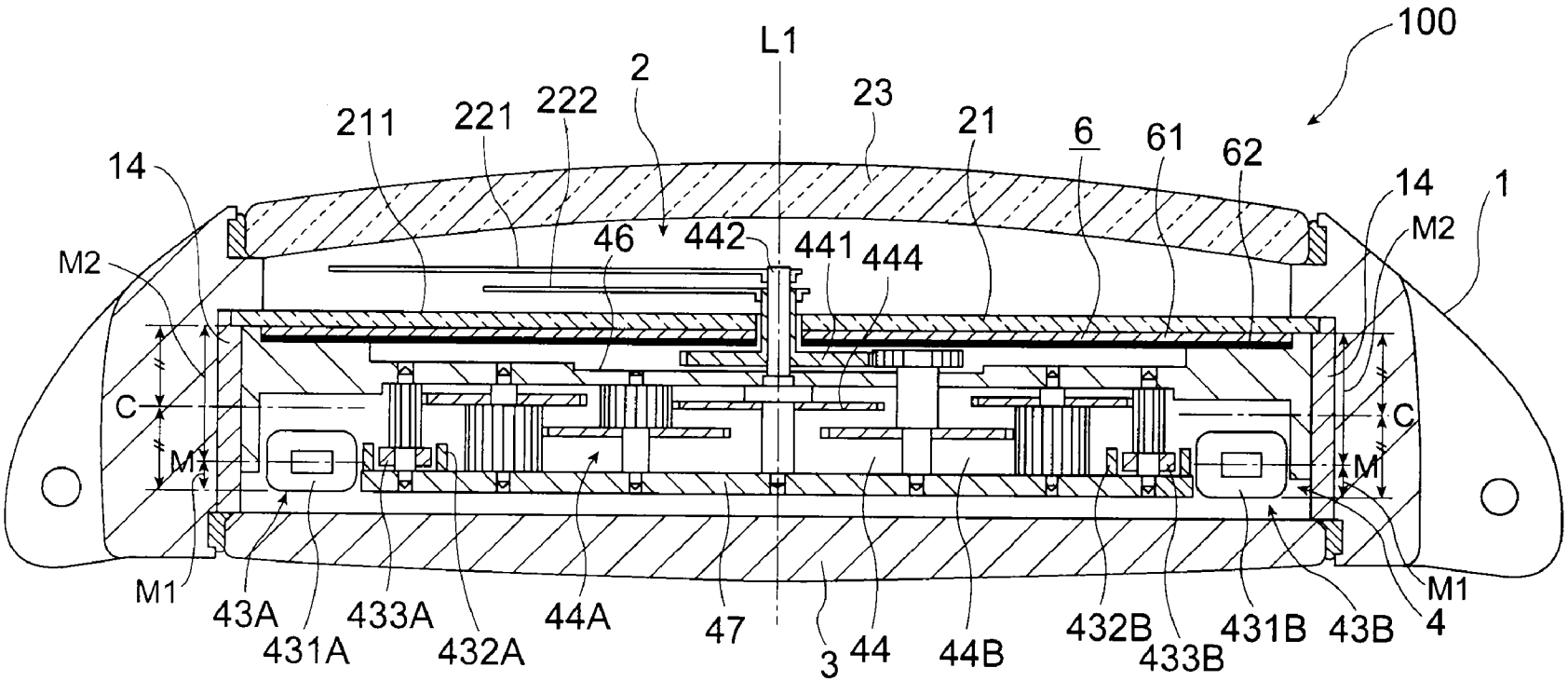
FIG. 2 is a section view through line II-II in FIG. 1.
Figure 3:
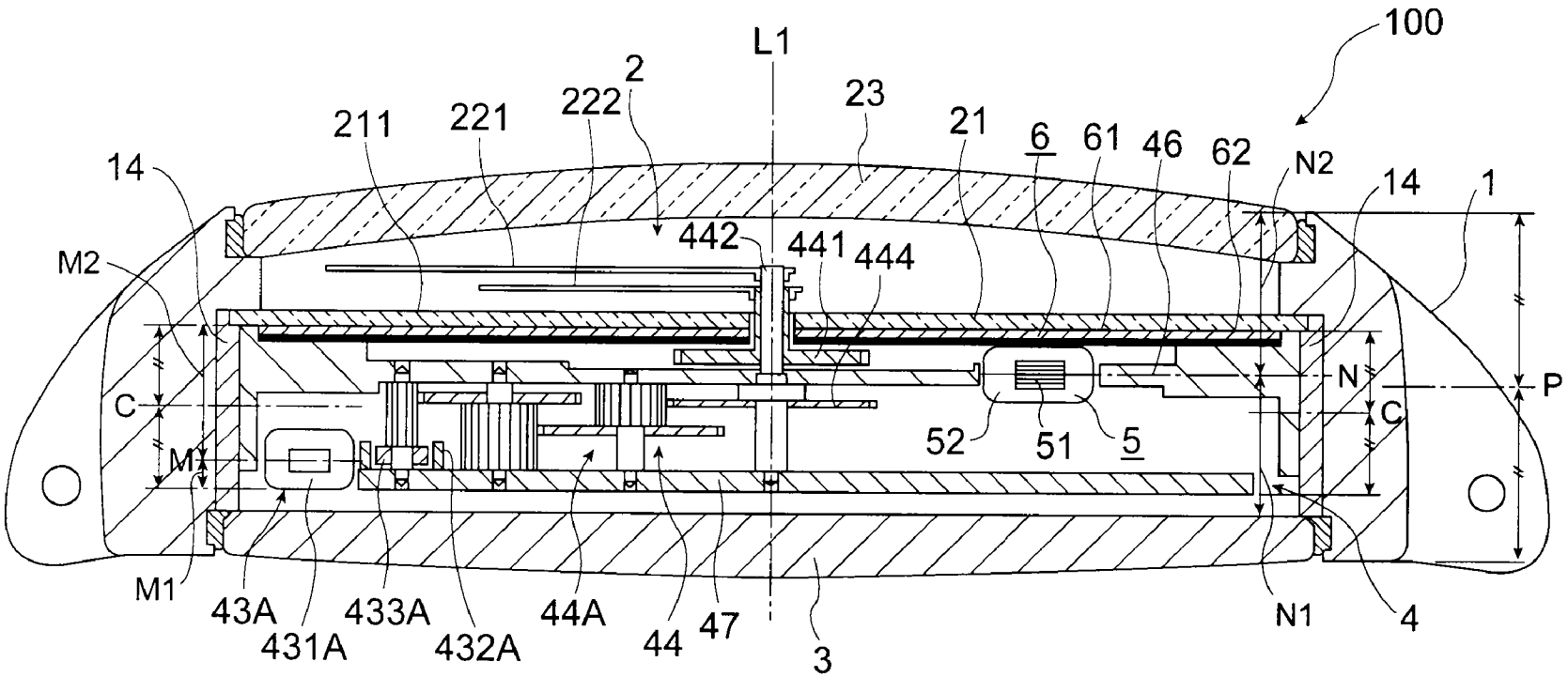
FIG. 3 is a section view through line III-III in FIG. 1.

FIG. 1 is a plan view of a radio-controlled timepiece 100 as an electronic timepiece with a radio communication function according to a first embodiment of the present invention, FIG. 2 is a section view through line II-II in FIG. 1, and FIG. 3 is a section view through line III-III in FIG. 1.

This radio-controlled timepiece 100 is a wristwatch, and as shown in FIG. 1, FIG. 2, and FIG. 3 has a ring-shaped (a short cylindrical shape of which both ends are open) case member 1.

The case member 1 is a ring-shaped member of which both ends along the cylindrical axis L1 are open, cylindrical axis L1 being the axial direction of the gears that drive the hands (such as the axial direction of second wheel 444), and is made from metal such as brass, stainless steel, or titanium alloy. The thickness of the case member 1 is less than the diameter of the ring, and is preferably 10 mm or less or 5 mm or less. Lugs 11, 12 for attaching a wristwatch band are formed at mutually opposite positions on the outside circumference of the case member 1. As viewed from the center of the case member 1, the direction in which one of the lugs 11, 12 is rendered is the 12:00 direction, and the direction in which the other of the lugs 11, 12 is rendered is the 6:00 direction. In FIG. 1, the top of the figure (the side at lugs 11) is the 12:00 direction, and the bottom (the side at lugs 12) is the 6:00 direction.

A stem 131 is disposed passing through the body of the case member 1 at approximately the 4:00 position. One end of the stem 131 is on the outside of the case member 1, and a crown 132 is disposed to this end. The other end of the stem 131 is inside the case member 1, and the yoke 133 and setting lever 134 are rendered to this end. The yoke 133 engages the clutch wheel 135 so that pulling the stem 131 out causes the clutch wheel 135 to move in the axial direction of the stem 131 by way of the intervening setting lever 134 and yoke 133, engaging the day wheel (not shown) so that the positions of the hands can be adjusted. A switching unit 13 enabling the positions of the hands to be manually adjusted from outside the case is formed by, for example, the stem 131, yoke 133, setting lever 134, and clutch wheel 135.

As shown in FIG. 2 and FIG. 3, a time display means 2 is disposed on the side of one opening in the case member 1, and a back cover (cover member) 3 closing the opening is disposed to the other opening (end portion) of the case member 1. The top as seen in FIG. 2 and FIG. 3 is the top of the radio-controlled timepiece 100, and the bottom as seen in the figures is the bottom of the radio-controlled timepiece 100. In addition, the direction along the cylindrical axis L1 is the thickness direction (height direction) of the radio-controlled timepiece 100.

The time display means 2 includes a dial 21 having a time display face 211 substantially perpendicular to the cylindrical axis L1 (perpendicular to the surface of the paper in FIG. 1) of the case member 1, and hands 221, 222 that rotate above the dial 21.

The dial 21 is substantially disc-shaped with an area large enough to cover the opening in the case member 1. The dial 21 is made from a nonconductive, nonmagnetic, optically transparent material such as inorganic glass, plastic, ceramic, paper, or other desirable material. The time display face 211 is rendered facing outward so that the face can be seen from the outside, and numbers, letters, or other indications (not shown) for representing the time are printed in a ring around the outside edge of the time display face 211.

The hands include the minute hand 221 for indicating the minute, and the hour hand 222 for indicating the hour. Both hands 221, 222 are made of bronze, aluminum, stainless steel, or other metal. The minute hands 221 and 22 rotate over the time display face 211 around substantially the center of the dial 21 as the axis of rotation, and indicate the time by pointing to the numbers, letters, or other markings on the time display face 211. The hands are thus a 12-hour analog time display means representing a twelve hour period with one revolution of the hour hand 222.

A crystal (cover member) 23 is further disposed opposite the dial 21 with the hands 221, 222 therebetween. The crystal 23 is disposed covering one opening in the case member 1, and the area of the crystal 23 is sufficient to cover this opening. The crystal 23 is made from a nonconductive, nonmagnetic, optically transparent material such as inorganic glass or organic glass.

A photoelectric generating means 6 is disposed on the crystal 23 side (that is, on the side of one opening) of the case member 1 on the opposite side as the time display face 211 of the dial 21. The photoelectric generating means 6 includes a photoelectric conversion element (photoelectric conversion unit) 61 for producing electricity by photoelectric conversion, and a support substrate 62 for supporting the photoelectric conversion element 61.

The photoelectric conversion element 61 is a substantially circular panel with substantially the same area as the dial 21, and is made by building sequentially in order from the dial 21 side a transparent electrode layer (TOC), a semiconductor layer, and another transparent electrode layer (not shown). The transparent electrode layer has a transparent conductor film made of, for example, SnO2, ZnO, or ITO (indium tin oxide). The semiconductor layer is a PIN photodiode made of microcrystalline or amorphous silicon with a pn junction design. A reflective metal coating can be deposited on the transparent electrode layer on the side opposite from the dial 21.

The support substrate 62 is made from polyimide, glass-impregnated epoxy, ceramic, or other nonmagnetic, nonconductive material. The support substrate 62 is a flat member with substantially the same area as the photoelectric conversion element 61, and is bonded to the photoelectric conversion element 61 on the opposite side as the dial 21.

The photoelectric generating means 6 is secured by bonding the photoelectric conversion element 61 to the dial 21.

The back cover 3 is disposed covering the other open end of the case member 1 opposite the dial 21 with a specific distance therebetween, and the area of the back cover 3 is sufficient to close this opening. The back cover 3 is made from a conductive, nonmagnetic metal such as stainless steel, bronze, or titanium alloy, or a conductive, magnetic metal such as permalloy.

A movement 4 with a timekeeping function, a plastic spacer 14 for holding the movement 4 inside the case member 1, a battery 49 for supplying power to the movement 4, and an antenna 5 for receiving a standard time signal, are disposed inside the case member 1 between the dial 21 and back cover 3.

The movement 4 includes quartz oscillator unit 41 including a quartz oscillator 411 (see FIG. 4), a circuit block (control block) 42 with a control function, drive means including stepping motors (electromagnetic motor) 43A, 43B for rotationally moving the hands 221, 222, a gear train 44 for conveying the drive power of the stepping motors 43A, 43B as rotational movement to the hands 221, 222, and a main plate 46 and gear train holder 47 for holding the gear train 44 therebetween in the cylindrical axis L1 direction of the case member 1.

The quartz oscillator unit 41 has a quartz oscillator 411 for generating a reference clock. A 60-kHz quartz oscillator 412 and a 40-kHz quartz oscillator 413 are also provided as quartz oscillators for generating tuning signals for tuning to the frequency of the standard radio signal (60 kHz and 40 kHz). These quartz oscillators 412, 413 for generating tuning signals are disposed substantially in the direction of 9:00.

Figure 4:
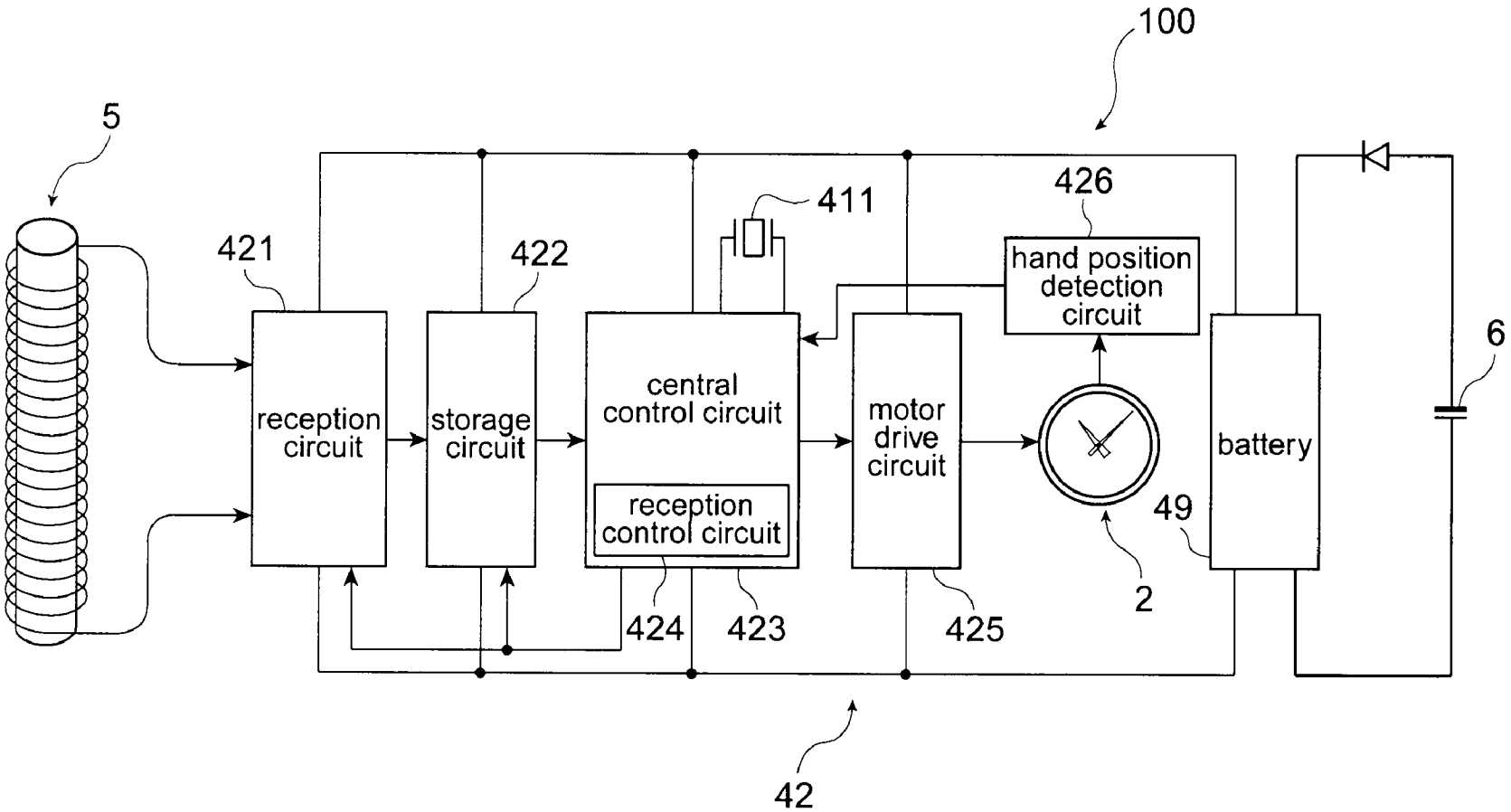
FIG. 4 is a function block diagram of a radio-controlled timepiece according to this first embodiment of the present invention.

The quartz oscillator unit 41 and circuit block 42 are disposed substantially in the direction of 12:00. FIG. 4 is a function block diagram of the circuit block 42.

The circuit block 42 includes a reception circuit 421 for processing the standard radio signal received by the antenna 5 and outputting time information; a storage circuit 422 for storing the time information output by the reception circuit 421; a central control circuit 423 for counting the current time based on the clock pulse from the quartz oscillator 411, and correcting the current time based on the received time information; a motor drive circuit 425 for driving stepping motors 43A, 43B; and a hand position detection circuit 426 for detecting the hand positions.

The reception circuit 421 includes an amplifier circuit for amplifying the standard radio signal received by the antenna 5, a filter for extracting a desired frequency component, a demodulation circuit for signal demodulation, and a decoder circuit for decoding the received signals.

The storage circuit 422 temporarily stores the time information decoded by the reception circuit 421, and compares the stored time information decoded from multiple received signals to determine if signal reception was successful.

The photoelectric generating means 6 generates power from light incident thereon from the dial 21 side, and the generated power is stored in a battery (secondary cell) 49. A diode preventing the battery 49 from discharging is rendered between the photoelectric generating means 6 and battery 49. The various electronic circuits are driven by power from the battery 49.

The central control circuit 423 includes an oscillation circuit, frequency divider, current time counter for counting the current time, and a time correction circuit for adjusting the count of the current time counter according to the received time information. The central control circuit 423 also has a reception control circuit 424 for storing the reception schedule of the reception circuit 421 and controlling the reception operation. The reception schedule is set so that the standard time signal is received from 2:00 a.m. to 2:06 a.m. When the switching unit 13 is manually operated to send a command to the reception control circuit 424 to force time signal reception, an output signal from the reception control circuit 424 causes the reception circuit 421 to receive.

The motor drive circuit 425 applies drive pulses to the stepping motors 43A, 43B at a timing controlled by the central control circuit 423.

The hand position detection circuit 426 detects the positions of the hands (minute hand 221, hour hand 222), and outputs the result to the central control circuit 423. The central control circuit 423 then compares the detection result from the hand position detection circuit 426 with the current count of the current time counter. Based on the result of this comparison, motor pulses are output to the motor drive circuit 425 so that the value of the counter matches the positions of the hands.

The drive means includes a minute hand stepping motor 43A for rotationally driving the minute hand 221, and an hour hand stepping motor 43B for rotationally driving the hour hand 222.

The stepping motors 43A, 43B each have a drive coil 431A, 431B for producing magnetic force as a result of drive pulses supplied from the motor drive circuit 425, a stator 432A, 432B excited by the drive coil 431A, 431B, and a rotor 433A, 433B rotated by the magnetic field excited by the stator 432A, 432B. The minute hand stepping motor 43A is located in approximately the 10:00 direction, and the hour hand stepping motor 43B is located in approximately the 8:00 direction.

The stepping motors 43A, 43B are rendered such that when seen from the side (that is, when viewing the radio-controlled timepiece 100 from the direction perpendicular to the cylindrical axis L1 of the case member 1), the drive coils 431A, 431B are at a position overlapping the gear train holder 47, and the drive coils 431A, 431B are thus disposed proximally to the back cover 3. The center M in the thickness direction (height direction) of the drive coil 431A, 431B is located closer to the back cover 3 than the center C in the thickness direction (height direction) of the movement 4, that is, closer to the back cover 3 than a position equidistant to the main plate 46 and gear train holder 47. As a result, the distance M1 from the center M in the thickness direction of the drive coil 431A, 431B to the bottom side of the gear train holder 47 is less than the distance M2 from the center M in the thickness direction of the drive coil 431A, 431B to the top side of the main plate 46.

The gear train 44 includes minute hand gear train 44A, which is linked between the minute hand stepping motor 43A and the second wheel 444 that rotates in unison with the minute hand shaft 442 to which the minute hand 221 is connected, for transferring rotation of the rotor 433A, 433B to the hands 221, 222; and hour hand gear train 44B connecting the hour hand stepping motor 43B to the center wheel 441 to which the hour hand 222 is connected. The gear train 44 can be made from any material providing sufficient strength, including stainless steel or other metal, or ceramic, plastic, or other nonconductive, nonmagnetic material.

The main plate 46 axially supports the gear train 44 on the dial 21 side, and the gear train holder 47 axially supports the gear train 44 on the back cover 3 side. The main plate 46 and gear train holder 47 are made from a nonconductive, nonmagnetic material such as plastic or ceramic.

The gear train 44, stepping motors 43A, 43B, and circuit block 42 are integrally rendered between the main plate 46 and gear train holder 47, forming the movement 4.

Note that the photoelectric generating means 6 could be fastened with screws to the movement 4, or assembled to the movement 4 by means of a spacer member that is snap-fit to the movement 4.

The spacer 14 is a ring-shaped member around the inside circumference of the case member 1, surrounding the outside edge of the movement 4. The spacer 14 holds the movement 4 inside the case member 1. The spacer 14 is made from a nonconductive, nonmagnetic material such as plastic or ceramic.

The battery 49 is a secondary cell for storing power generated by the photoelectric generating means 6, is connected directly to the photoelectric generating means 6, and has a metal outside case. The battery 49 is located in approximately the 2:00 direction occupying the space from approximately 1:00 to approximately 3:00.

The antenna 5 includes a core 51 made from ferrite, amorphous metal, or other high permeability material, and a coil 52 wound in multiple layers to the core 51. To reduce core loss, the core 51 is made from multiple foil layers so that the external shape when seen in section is substantially rectangular. The foil layers are bonded together with epoxy or other insulating adhesive.

When seen from a side view of the radio-controlled timepiece 100, the antenna 5 is rendered with the antenna axis substantially parallel to the plane of the support substrate 62 on the back cover 3 side of the support substrate 62 relative to the photoelectric conversion element 61, that is, adjacent to the back cover 3 side surface of the support substrate 62 on the opposite side of the support substrate 62 as the photoelectric conversion element 61. Therefore, when viewed from the direction parallel to the cylindrical axis L1 of the case member 1, that is, when seen in the plan view of the radio-controlled timepiece 100, the antenna 5 is substantially completely covered by the support substrate 62 and photoelectric conversion element 61 of the photoelectric generating means 6. Note that the antenna 5 can be rendered touching the support substrate 62 or within a specific gap to the support substrate 62. The specified distance between the antenna 5 and support substrate 62 can be appropriately predetermined to assure good signal reception by the antenna 5 with consideration for the shape of the antenna 5, and the material and size of the support substrate 62.

In this embodiment of the invention the antenna 5 is rendered passing through the main plate 46 and protruding to the photoelectric generating means 6 side with the outside portion of the antenna 5 contacting the bottom of the support substrate 62. This renders the center N in the thickness direction (height direction) of the core 51 on the dial 21 side of the center C in the thickness direction (height direction) of the movement 4. The center N in the thickness direction (height direction) of the core 51 is on the dial 21 (that is, photoelectric generating means 6) side of the center P in the thickness direction of the metal case member 1. The distance N2 from the center N in the thickness direction of the core 51 (antenna 5) to the edge of the case member 1 on the opposite side from the back cover 3 (the dial 21 side) is therefore less than the distance N1 from the center N in the thickness direction of the core 51 (antenna 5) to the top of the back cover 3.

The antenna 5 is located in about the 6:00 direction when the radio-controlled timepiece 100 is seen in plan view with the antenna axis substantially parallel to the line between the 3:00 direction and 9:00 direction. Furthermore, when the radio-controlled timepiece 100 is seen in plan view, the antenna 5 is disposed opposite the battery 49 with the switching unit 13 therebetween.

The operation of a radio-controlled timepiece 100 thus comprised according to this first embodiment of the present invention is described next.

The current time kept by the time counter is updated according to the reference clock generated by frequency dividing oscillations of the quartz oscillator 411. The hand position detection circuit 426 detects the positions of the hands (minute hand 221, hour hand 222) and outputs the result to the central control circuit 423. The hand positions and count of the current time counter are then compared, and the stepping motors 43A, 43B are driven by means of the motor drive circuit 425 based on the result of this comparison. Rotation of the rotors 433A, 433B when the stepping motors 43A, 43B are driven is relayed by the gear train 44 to the hands 221, 222, and the current time is indicated by the hands 221, 222 pointing to numbers on the time display face 211.

Standard time signal reception and adjusting the time based on the time information in the standard time signal are described next.

The standard radio signal is received by the antenna 5. Being an electromagnetic wave, the standard radio signal includes electric field fluctuation oscillating perpendicularly to the direction of wave propagation, and magnetic field fluctuation oscillating perpendicularly to the direction of signal propagation and electric field fluctuation. The magnetic field fluctuation passes through the crystal 23, dial 21, and photoelectric generating means 6 and passes the core 51 of the antenna 5 and is thereby linked in the axial direction by the coil 52, producing an induction voltage in the coil 52 whereby the standard radio signal is received.

At 2:00 a.m., which is the reception starting time preset in the reception control circuit 424, the reception control circuit 424 outputs a start reception command to the reception circuit 421. The reception control circuit 424 also outputs the start reception command to the reception circuit 421 when the switching unit 13 is operated to force reception. When the reception circuit 421 receives the start reception command, power is drawn from the battery 49 and the reception circuit 421 starts decoding the signal (time information) received by the antenna 5.

The decoded time information is temporarily stored to the storage circuit 422, and the accuracy of the reception is determined by comparing the time information received in multiple signals (such as six signals). The current time of the current time counter is then updated by the time correction circuit according to the accurately received time information. The hand positions are then adjusted according to the time of the current time counter, and the time is indicated according to the received time.

When the dial 21 is exposed to light, the light passes through the crystal 23 and dial 21 and is incident on the photoelectric conversion element 61. Electricity is then produced by photoelectric conversion by the photoelectric conversion element 61, and the generated power (current) is supplied from the transparent electrodes to the battery 49 and stored. This first embodiment of the present invention thus affords the following benefits.

(1) Because the support substrate 62 is made from a nonmagnetic material, external magnetic fields can pass through the photoelectric generating means 6, and the antenna 5 located directly below the photoelectric generating means 6 can receive signals from the dial 21 side with good reception. The antenna 5 is therefore assured of good reception without being affected by the photoelectric generating means 6 while the back cover 3 and case member 1 can be made from metal materials to improve the appearance of the radio-controlled timepiece 100. In addition, the photoelectric generating means 6 can efficiently receive light and generate power without the antenna 5 interfering with incident light even when the antenna 5 is adjacent to the photoelectric generating means 6.

Furthermore, because the support substrate 62 is made from a nonconductive material, the support substrate 62 will not interfere with electric field components contained in the external standard radio signal. The electric field component of the standard radio signal can therefore efficiently pass through the photoelectric generating means 6, and the antenna 5 can receive signals from the dial 21 side with good reception.

(2) Because the antenna 5 is located on the back cover 3 side of the photoelectric generating means 6, and the support substrate 62 is rendered completely overlapping the antenna 5 when the radio-controlled timepiece 100 is seen in plan view, the antenna 5 is completely covered by the photoelectric generating means 6 and cannot be seen from the crystal 23. The appearance of the radio-controlled timepiece 100 is improved as a result. Furthermore, because signals can be received even with the antenna 5 disposed below the photoelectric generating means 6, the area of the photoelectric conversion element 61 can be maximized to the inside circumference of the case member 1, thus increasing the area exposed to light and affording good photoelectric conversion efficiency.

(3) Because the antenna 5 is disposed in contact with the support substrate 62 on the dial 21 side of the center C of the movement 4 and on the dial 21 side of the center P of the case member 1 in the thickness direction, the antenna 5 can be located proximally to the opening on the dial 21 side (crystal 23 side) of the case member 1, thus affording good signal reception from this opening and improving the reception sensitivity of the antenna 5. More specifically, because the distance N2 from the center N of the antenna 5 to the edge of the case member 1 on the dial 21 side is less than distance N1 from the center N of the antenna 5 to the back cover 3, external signals can enter easily from the opening in the case member 1 on the dial 21 side.

Furthermore, because the antenna 5 is disposed to a position separated from the back cover 3, signals entering from outside the timepiece can be prevented from being pulled in by the conductive back cover 3, and good signal reception by the antenna 5 can be reliably assured. Because other components (parts) of the radio-controlled timepiece 100 are not located between the antenna 5 and support substrate 62, the antenna 5 can reliably receive signals with good reception without other components interfering with signal reception.

Note that this can also be applied to electronic timepieces with a radio communication function in which a photoelectric generating means 6 is not provided. If the center N of the antenna 5 is on the dial 21 side of the center P of the case member 1, that is, if distance N2 from the antenna center N to the edge of the case member 1 on the dial 21 side is less than the distance N1 from the antenna center N to the back cover 3, the antenna 5 can more easily receive signals from the opening in the case member 1 on the dial 21 side even if the back cover 3 is made from metal or other electrically conductive material.

(4) Furthermore, because the drive coils 431A, 431B of the stepping motors 43A, 43B are rendered proximally to the back cover 3, the axis of the antenna 5 and the axis of the drive coils 431A, 431B can be separated from each other when seen in a side view of the radio-controlled timepiece 100. Current flow to the drive coil 431A, 431B normally produces a weak field around the drive coil 431A, 431B, but because these drive coils 431A, 431B are separated from the antenna 5, the effect of this weak field on the antenna 5 can be reduced.

Furthermore, because the drive coils 431A, 431B are located adjacent to the back cover 3, external signals are prevented from being pulled in by the stators 432A, 432B, and the antenna 5 can easily receive signals from the opening on the dial 21 side of the case member 1.

(5) Because the switching unit 13 is located between the antenna 5 and battery 49, the effect of the external metal case of the battery 49 on the magnetic field around the antenna 5 can be minimized, thereby assuring even more reliable, accurate signal reception by the antenna 5.

(6) Because the antenna 5 is disposed with the axis thereof substantially parallel to a line through the 3:00 direction and 9:00 direction, signals can be reliably received with good reception by the antenna 5 without the wristwatch band interfering with the signal field even when a metal wristwatch band is attached to the lugs 11, 12 because the wristwatch band does not interfere with a line extended along the axis of the antenna 5.

(7) Because the dial 21 and crystal 23 are made from a nonconductive and nonmagnetic material, signals entering from the opening on the crystal 23 side of the case member 1 can pass through the dial 21 and crystal 23. The antenna 5 can therefore receive signals entering from this opening in the case member 1 with good reception.

Second Embodiment

A second embodiment of the present invention is described next. This second embodiment differs from the first embodiment in the arrangement of the photoelectric generating means 6 and antenna 5.

Figure 5:
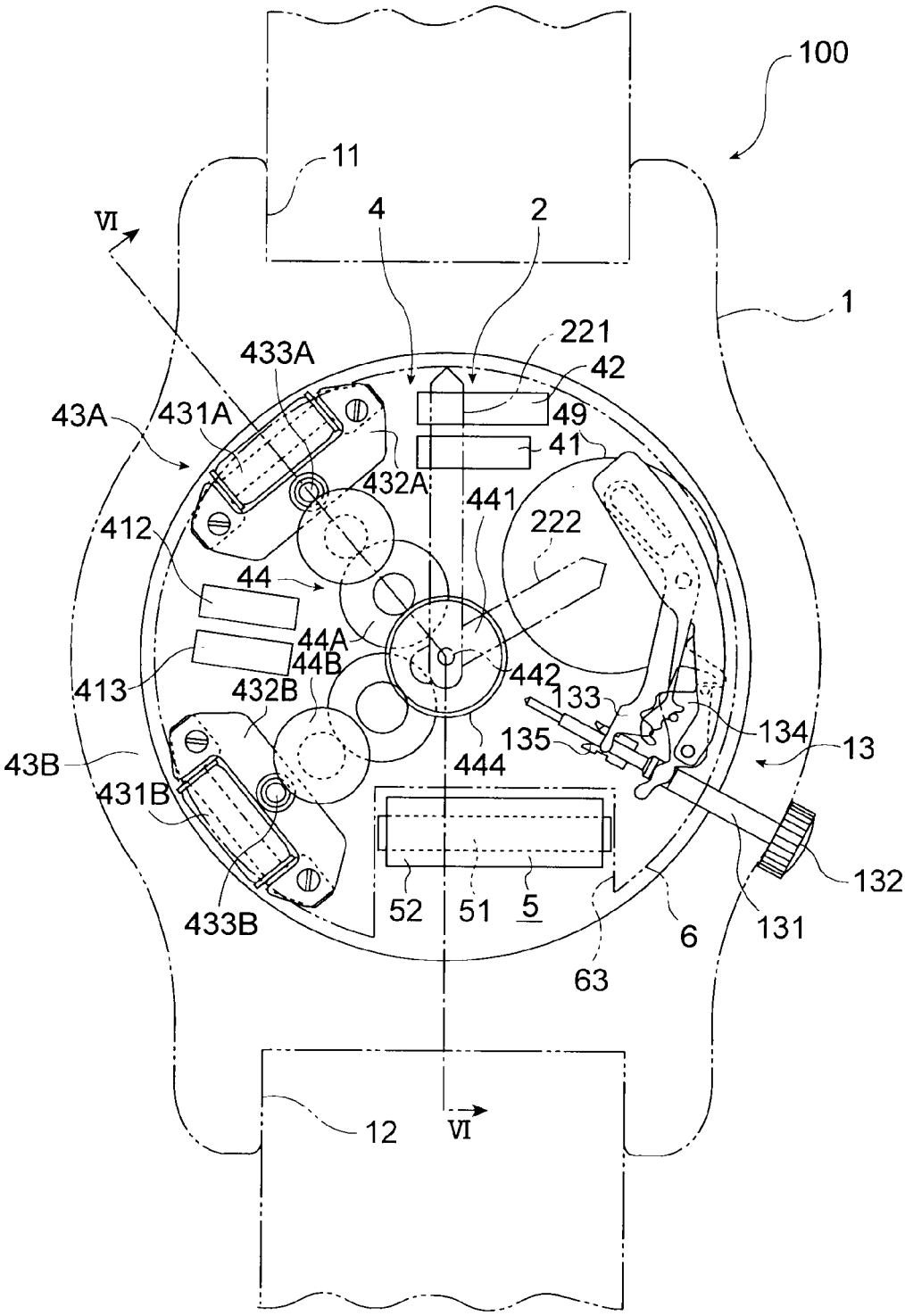
FIG. 5 is a plan view of a radio-controlled timepiece according to a second embodiment of the present invention.
Figure 6:
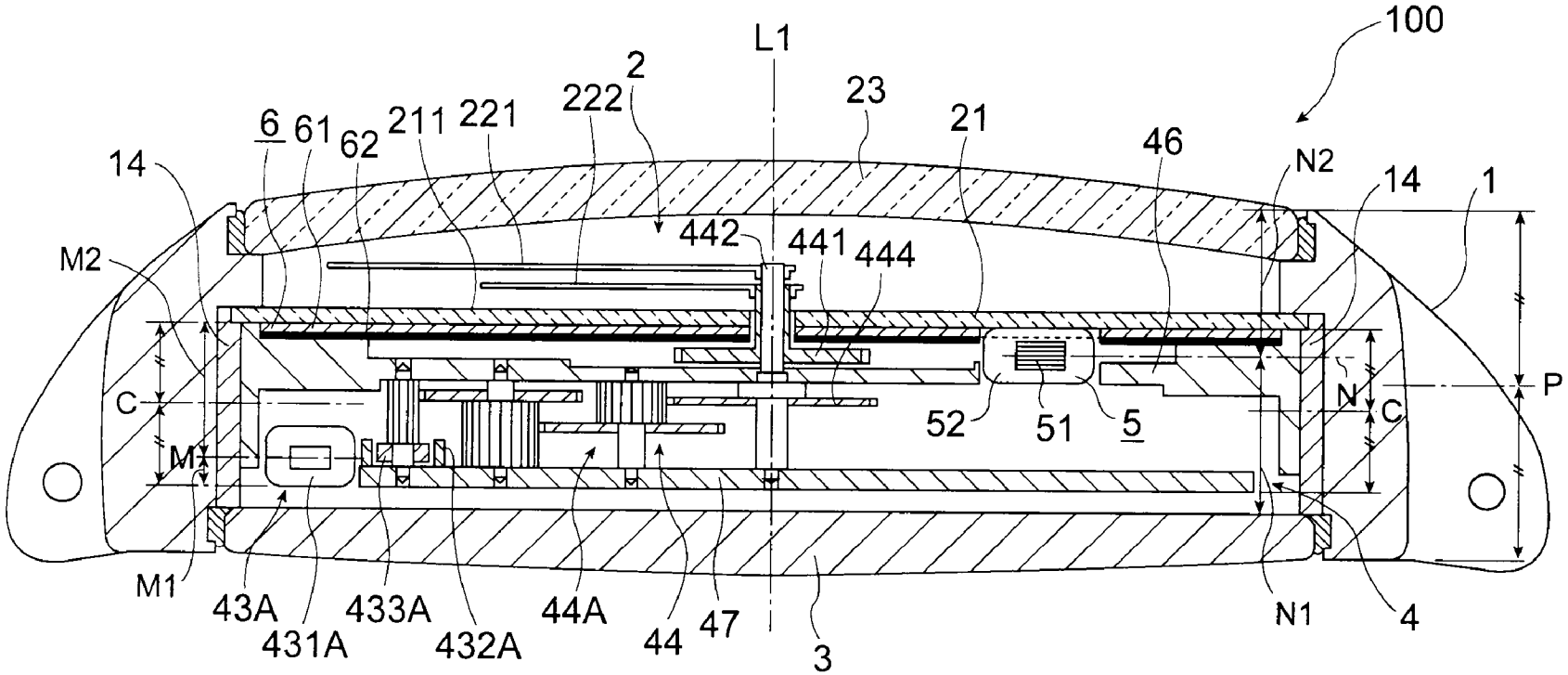
FIG. 6 is a section view through line VI-VI in FIG. 5.

FIG. 5 is a plan view of a radio-controlled timepiece 100 according to a second embodiment of the invention, and FIG. 6 is a section view through line VI-VI in FIG. 5. As shown in FIG. 5 and FIG. 6, the photoelectric generating means 6 is a substantially circular disk with area approximately equal to the dial 21 and an approximately C-shaped notch 63 enclosing the antenna 5 is formed according to the shape of the antenna 5 at approximately 6:00. As a result, the antenna 5 and photoelectric generating means 6 are rendered so as to not overlap when the radio-controlled timepiece 100 is seen in plan view. The support substrate 62 is made from stainless steel or other conductive metal material. The material of the support substrate 62 could be a material that is magnetic, nonmagnetic, or has both properties.

When the radio-controlled timepiece 100 is seen in side view, the antenna 5 is disposed passing through and protruding in part from the photoelectric generating means 6 directly below the dial 21, that is, adjacent to the side opposite from the time display face 211. The antenna 5 can be rendered contacting the dial 21 or proximally thereto within a specific gap to the dial 21.

With this arrangement the antenna 5 (including the coil 52) and the support substrate 62 are mutually overlapping in a side view of the radio-controlled timepiece 100.

Note that in this second embodiment the center N in the thickness direction (height direction) of the core 51 of the antenna 5 is on the dial 21 side of the center C in the thickness direction (height direction) of the movement 4. Furthermore, the center N in the thickness direction (height direction) of the core 51 is on the dial 21 side of the center P in the thickness direction of the metal case member 1. The distance N2 from the center N in the thickness direction of the core 51 (antenna 5) to the edge of the case member 1 on the dial 21 side is thus less than the distance N1 from the center N in the thickness direction of the core 51 (antenna 5) to the back cover 3. This arrangement facilitates signal reception by the antenna 5 from the opening in case member 1 on the dial 21 side.

In addition to the benefits (4), (5), (6), and (7) of the first embodiment described above, this second embodiment of the invention also affords the following benefits.

(8) By forming a notch 63 in the photoelectric generating means 6, the antenna 5 can be rendered overlapping the support substrate 62 in a side view of the radio-controlled timepiece 100. The antenna 5 can therefore be located the thickness of the photoelectric generating means 6 closer to the dial 21, and closer to the crystal 23 than in the first embodiment. Signals can therefore be received more reliably through the case opening because the antenna 5 is located even closer to the opening in the case member 1. Because other component parts (members) of the radio-controlled timepiece 100 are not located between the antenna 5 and dial 21 in this embodiment, the antenna 5 is assured of good, reliable reception without other component parts interfering with signals entering the case.

Furthermore, the antenna 5 is located overlapping the support substrate 62 in a side view of the radio-controlled timepiece 100 at a position on the dial 21 side of the center C of the movement 4 and the dial 21 side of the center P in the thickness direction of the case member 1. That is, the distance N2 from the center N of the antenna 5 to the edge of the case member 1 on the dial 21 side is less than the distance N1 from the center N of the antenna 5 to the back cover 3. Therefore, as in benefit (3) of the first embodiment, signals can be received with good reception from the dial 21 side opening in the case member 1, and the reception sensitivity of the antenna 5 can be improved.

(9) By forming a notch 63 in the photoelectric generating means 6, the antenna 5 and photoelectric generating means 6 can be rendered without overlapping in a plan view of the radio-controlled timepiece 100. As a result, the magnetic field entering the antenna 5 will not be obstructed and the antenna 5 is afforded good reception performance even if the support substrate 62 is made from a metal material. The support substrate 62 can therefore be made from either a magnetic or nonmagnetic material, thus providing a wider range of selectable materials, and enabling improving the strength of the photoelectric generating means 6.

Note that because there will be no magnetic materials around the antenna 5 if the support substrate 62 is made from a nonconductive and nonmagnetic material, signal reception by the antenna 5 will be unhindered, and even more reliable, good reception performance can be achieved.

Third Embodiment

A third embodiment of the invention is described next. This third embodiment differs from the second embodiment in the configuration of the photoelectric generating means 6 and antenna 5.

Figure 7:
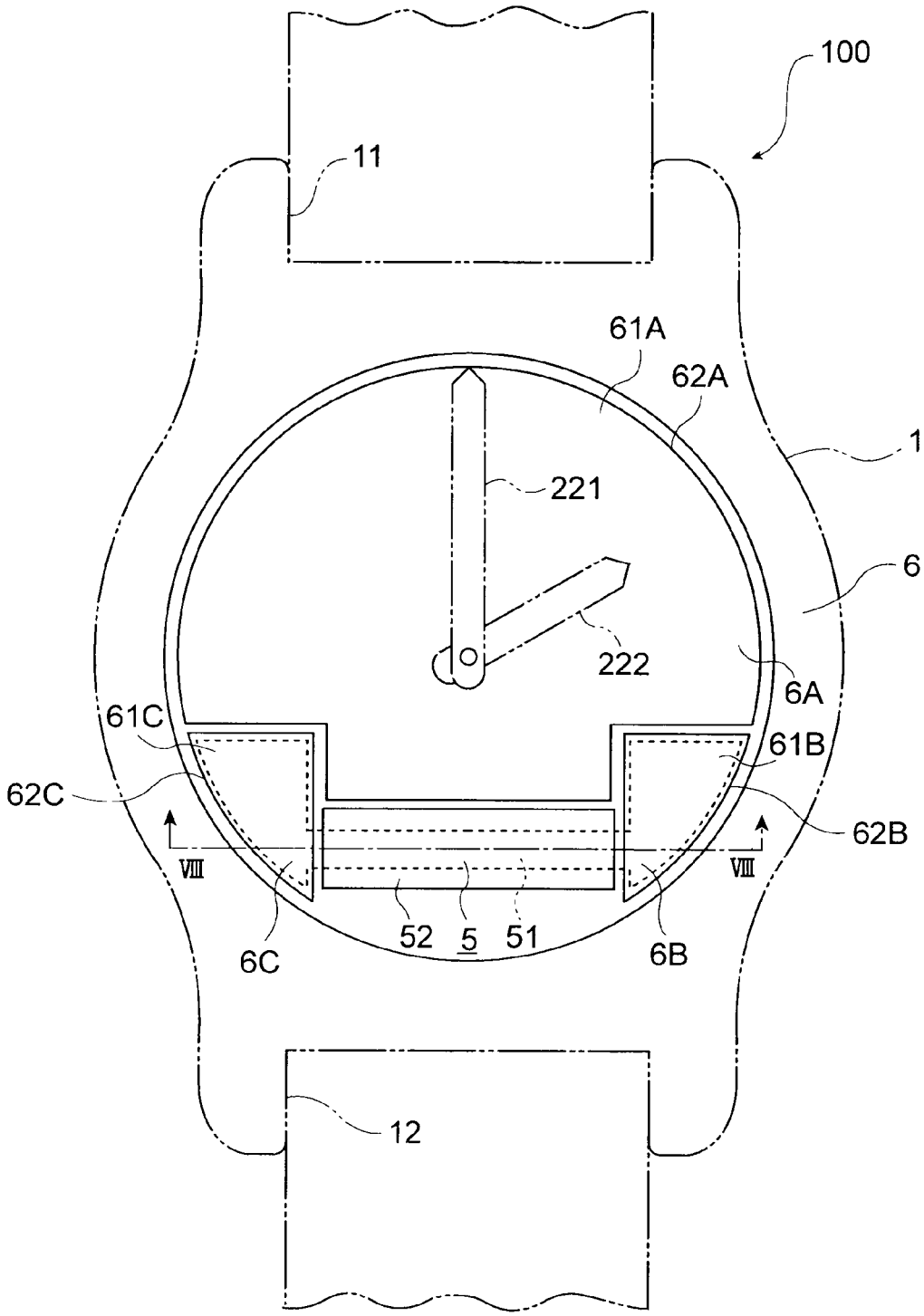
FIG. 7 is a plan view of a radio-controlled timepiece according to a third embodiment of the present invention.

FIG. 7 is a plan view of a radio-controlled timepiece 100 according to this third embodiment. As shown in FIG. 7, the photoelectric generating means 6 is divided into three portions (6A, 6B, 6C), and the photoelectric conversion elements 61A, 61B, 61C of these three photoelectric generating means 6A, 6B, 6C are connected in series to improve the electromotive force (voltage). As in the second embodiment, the support substrates 62A, 62B, 62C of these can be made from a conductive, high permeability magnetic material such as amorphous metal, permalloy, or stainless steel.

Photoelectric generating means 6B and 6C are rendered at approximately 4:00 and approximately 8:00 at positions corresponding to the ends of the antenna 5. These photoelectric generating means 6B and 6C are triangularly shaped with substantially the same size as the corresponding photoelectric conversion elements 61B, 61C and support substrates 62B, 62C. When seen in a plan view of the radio-controlled timepiece 100, the photoelectric generating means 6A, 6B, 6C do not overlap. The support substrates 62B, 62C and photoelectric conversion elements 61B, 61C of the photoelectric generating means 6B, 6C are mutually insulated, and the photoelectric conversion elements 61B, 61C are electrically connected to photoelectric generating means 6A.

The photoelectric generating means 6A is disposed in the direction of 12:00, having an odd shape with a tab protruding from the flat side of a substantially semicircular plate so as to substantially cover the area enclosed between the inside circumference of the case member 1, the photoelectric generating means 6B, 6C, and the antenna 5. The photoelectric generating means 6A therefore covers the larger portion of the opening in the case member 1, has area greater than the photoelectric generating means 6B, 6C, and is a major portion of the photoelectric generating means 6. When seen in a plan view of the radio-controlled timepiece 100, these photoelectric generating means 6A, 6B, 6C do not overlap.

The number of segments in the photoelectric generating means 6 shall not be limited to three, and the photoelectric generating means 6 can be segmented into two, four, or other desirable number of parts. Furthermore, the multiple photoelectric generating means 6A, 6B, 6C are not necessarily connected with the photoelectric conversion elements 61A, 61B, 61C in series, and the segments could be parallel connected.

The antenna 5 is located at approximately 6:00 with the antenna axis substantially parallel to a line through 3:00 and 9:00. The ends of the core 51 have substantially the same triangular shape as the plane shape of the photoelectric generating means 6B, 6C, and are electrically connected to the corresponding support substrates 62B, 62C by adhesion, welding, or other means.

Figure 8:
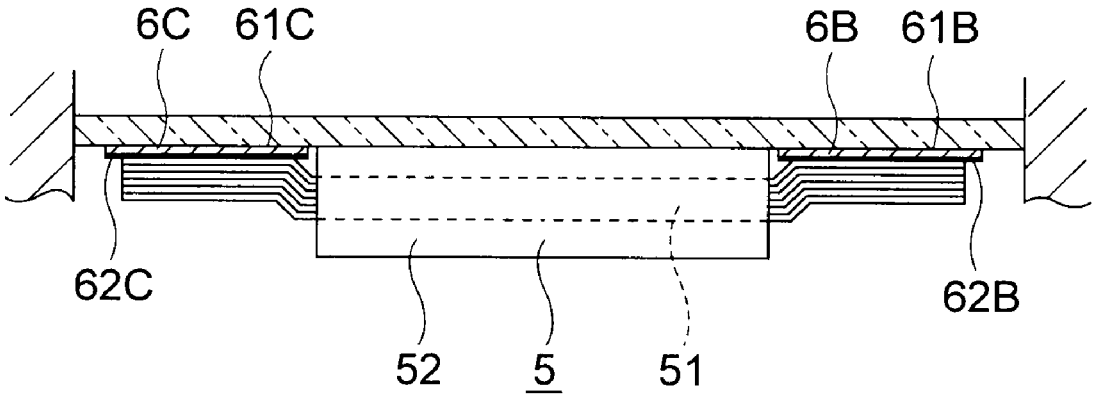
FIG. 8 is a partial section view through line VIII-VIII in FIG. 7.

FIG. 8 is a partial section view through line VIII-VIII in FIG. 7. As shown in FIG. 8, both end portions of the core 51 outside of the coil 52 are bent to the photoelectric generating means 6B, 6C side. As a result, both ends of the core 51 are located in greater proximity to the dial 21 side (the open side of the case member 1), and the photoelectric generating means 6B, 6C are disposed in contact with the dial 21. Note that the photoelectric generating means 6B, 6C can be magnetically connected to the core 51 without bending the ends of the core 51, and as a result the photoelectric generating means 6B, 6C can be located separated from the dial 21.

In addition to affording the same benefits as benefits (3), (4), (5), (6), and (7) of the first embodiment, this third embodiment of the invention also affords the following benefits.

(10) Because the support substrates 62B, 62C and both ends of the core 51 of the antenna 5 are magnetically connected, the magnetic field of the standard radio signal can be guided to the antenna 5 by the broad area of both ends of the core 51 and the support substrates 62B, 62C. Flux linkage can thus be improved, and the reception sensitivity of the antenna 5 can be improved.

Furthermore, by bonding both end portions of the antenna 5 to the support substrates 62B, 62C, the photoelectric generating means 6B, 6C can be formed to said portions, and the reception sensitivity of the antenna 5 can be improved without reducing the light receiving area of the photoelectric generating means 6.

(11) Unlike the photoelectric generating means 6B, 6C guiding the magnetic field to the antenna 5, the photoelectric generating means 6A is formed in a shape that does not overlap the antenna 5 when seen in a plan view of the radio-controlled timepiece 100. As a result, as in benefit (8) of the second embodiment, the support substrate 62A can be made from a metal or other magnetic material without interfering with signal reception by the antenna 5. The strength of the photoelectric generating means 6 can therefore be improved.

Furthermore, because the support substrates 62A, 62B, 62C do not overlap the coil 52 part of the antenna 5 in the plan view of the radio-controlled timepiece 100, the antenna 5 can be disposed more closely to the crystal 23, and signals can be dependably received by the antenna 5 as described in benefit (9) of the second embodiment.

(12) The electromotive force can also be improved because three photoelectric generating means 6A, 6B, 6C are provided connected together in series.

It should be noted that the present invention shall not be limited to the embodiments described above, and various modifications and improvements capable of achieving the object of the invention are included within the scope of this invention.

For example, the shape of the photoelectric generating means shall not be limited to the preceding embodiments, and can be desirably determined with consideration for the shape of the outside case and the location of the drive means, for example.

Figure 9:
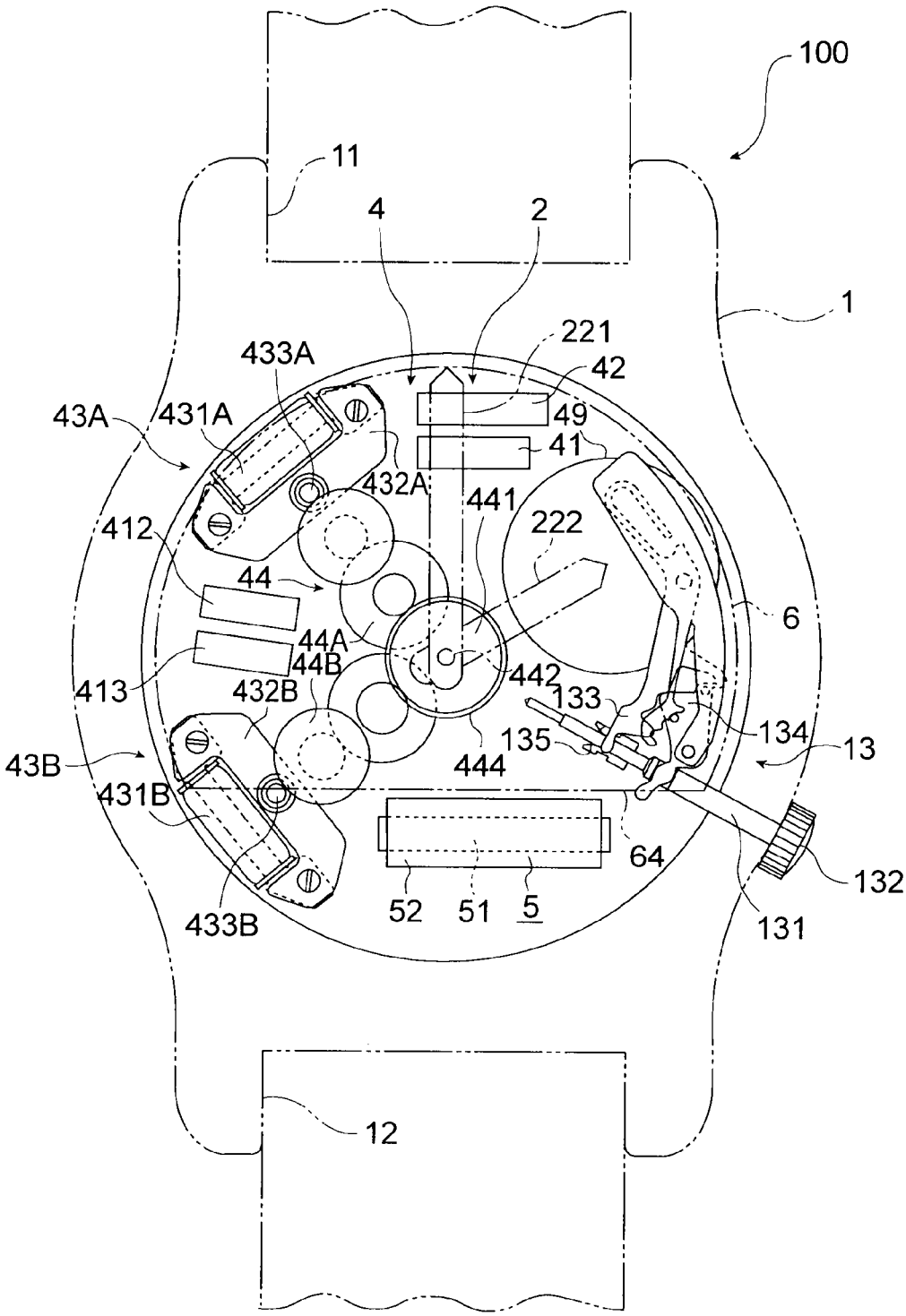
FIG. 9 is a plan view of a radio-controlled timepiece according to the present invention showing a variation of the photoelectric generating means.

FIG. 9 is a plan view of a radio-controlled timepiece 100 showing a variation of the photoelectric generating means according to the present invention. As shown in FIG. 9, the photoelectric generating means 6 is substantially semicircular in shape with a straight side 64 formed on the 6:00 side of the circle. The straight side 64 is formed parallel to the axis of the antenna 5 along one long side of the antenna 5 exterior, that is, parallel to a line joining 3:00 and 9:00. The antenna 5 and photoelectric generating means 6 therefore do not overlap in a plan view of the radio-controlled timepiece 100.

Because the support substrate of the photoelectric generating means 6 does not overlap the antenna 5 when seen in plan view with a photoelectric generating means 6 thus shaped, the antenna 5 can receive signals from the photoelectric generating means 6 side of the case member with good reception even if the support substrate is made from a magnetic material or conductive material. The photoelectric generating means 6 is also not disposed in the area at both ends of the antenna 5 because the photoelectric generating means 6 has a straight side 64. Therefore, even if the support substrate of the photoelectric generating means 6 is made from a magnetic material or conductive material, for example, the signal field reaches both ends of the antenna 5 from the photoelectric generating means 6 side opening in the case member 1 easily and signals can be received with good reception.

Signals entering from the dial 21 side can also be easily received in this case because the antenna 5 is rendered directly below adjacent to or in contact with the dial 21.

It will thus be apparent that insofar as area sufficient to generate sufficient power to operate the drive means is assured, the shape of the photoelectric conversion means shall not be limited to circular or semicircular, and the photoelectric generating means could be rectangular, triangular, or other desirable shape, including cartoon character shapes, for example.

The location of the photoelectric generating means can therefore be determined appropriately with consideration for the location of other components as seen in a plan view of the radio-controlled timepiece.

The shape of the case member shall also not be limited to the cylindrical shape described in the preceding embodiments, and the shape can be determined desirably according to the application and design of the timepiece, including square cylinders and other odd cylindrical shapes. In this case the shape of the photoelectric generating means can be determined according to the internal circumferential shape of the case member, or the photoelectric generating means can be shaped differently than the case member. Note that if the photoelectric generating means is shaped according to the internal circumferential shape of the case member, the area of the photoelectric conversion means can be maximized and good photoelectric conversion efficiency can be achieved.

The case member shall also not be limited to having both ends thereof open, and could, for example, be a tubular shape with a bottom. In other words, the case member must simply be open on one end. The case member could also be an assembly of multiple integrally assembled external parts, including a body for holding the movement and a bead for holding the crystal. The case member is also not limited to metal components. For example, the surface of a case member made from molded synthetic resin could be coated with a metallic thin film.

The location of the antenna inside the movement can also be determined as desired. For example, other watch components (component members) can be disposed between the antenna and back cover when the electronic timepiece with radio communication function is seen in side view.

Figure 10:
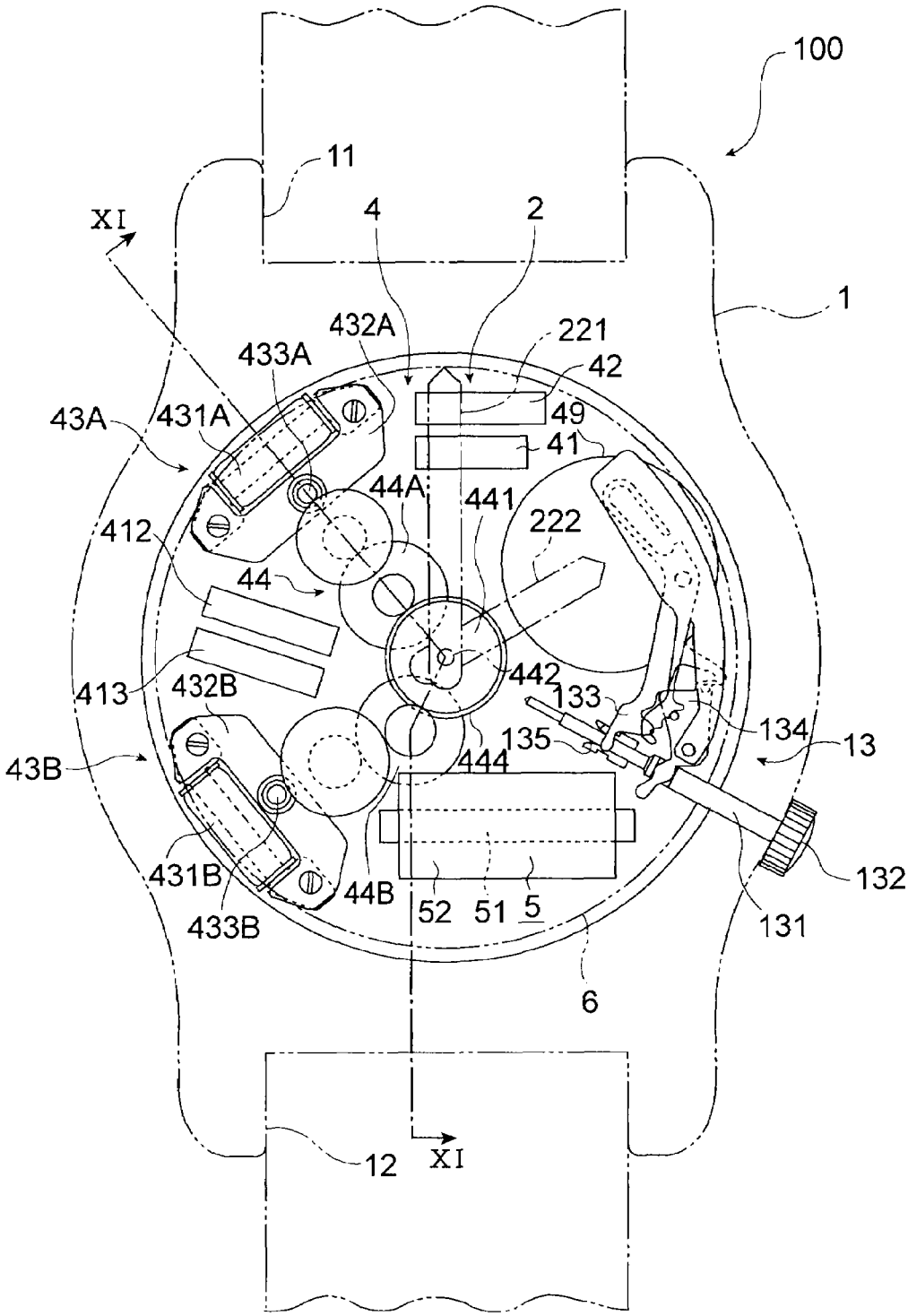
FIG. 10 is a plan view showing a variation of a radio-controlled timepiece according to the present invention.
Figure 11:
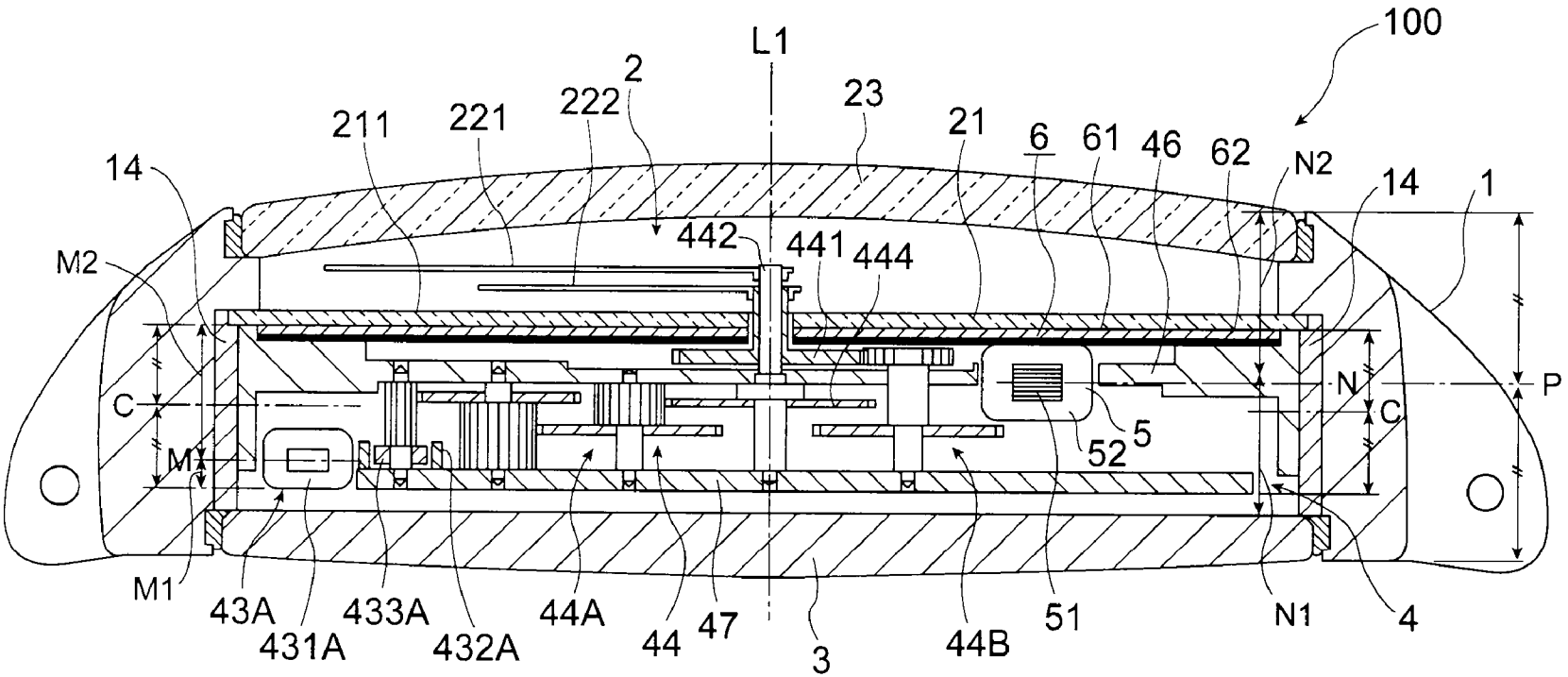
FIG. 11 is a section view through line XI-XI in FIG. 10.

FIG. 10 is a plan view showing another variation of a radio-controlled timepiece, and FIG. 11 is a section view through line XI-XI in FIG. 10. As in the above embodiments, in FIG. 10 and FIG. 11 the antenna 5 is proximally disposed to the dial 21 side in the movement 4. In this embodiment, gears that are part of the hour hand gear train 44B driven by hour hand stepping motor 43B are located between the antenna 5 and gear train holder 47 when seen in a side view of the radio-controlled timepiece 100. In other words, the hour hand gear train 44B is located overlapping the antenna 5 when seen in a plan view of the radio-controlled timepiece 100. A certain amount of space is afforded between the antenna 5 and gear train holder 47 by locating the antenna 5 adjacent to the dial 21. This space can then be used to hold other component parts of the radio-controlled timepiece 100, and the space efficiency of the radio-controlled timepiece 100 can be improved. This helps reduce the size of the radio-controlled timepiece 100. Furthermore, because the hour hand gear train 44B is located proximally to the antenna 5 in a plan view of the radio-controlled timepiece 100, a large space is afforded in the 9:00 direction of the radio-controlled timepiece 100, and the quartz oscillators 412, 413, for example, can be increased in size. The space between the antenna 5 and gear train holder 47 can thus be used efficiently by locating the antenna 5 proximally to the dial 21 side. Furthermore, the hour hand gear train 44B is not the only component that can be located between the antenna 5 and gear train holder 47, and the switching unit 13, circuit block 42, quartz oscillator unit 41, or other desirable part or member can be located between the antenna 5 and gear train holder 47 as desired.

The configuration of a radio-controlled timepiece according to the present invention shall not be limited to the preceding embodiments, and any configuration enabling correcting the displayed time according to a radio signal can be used, including, for example, timepieces having a calendar display function.

Figure 12:
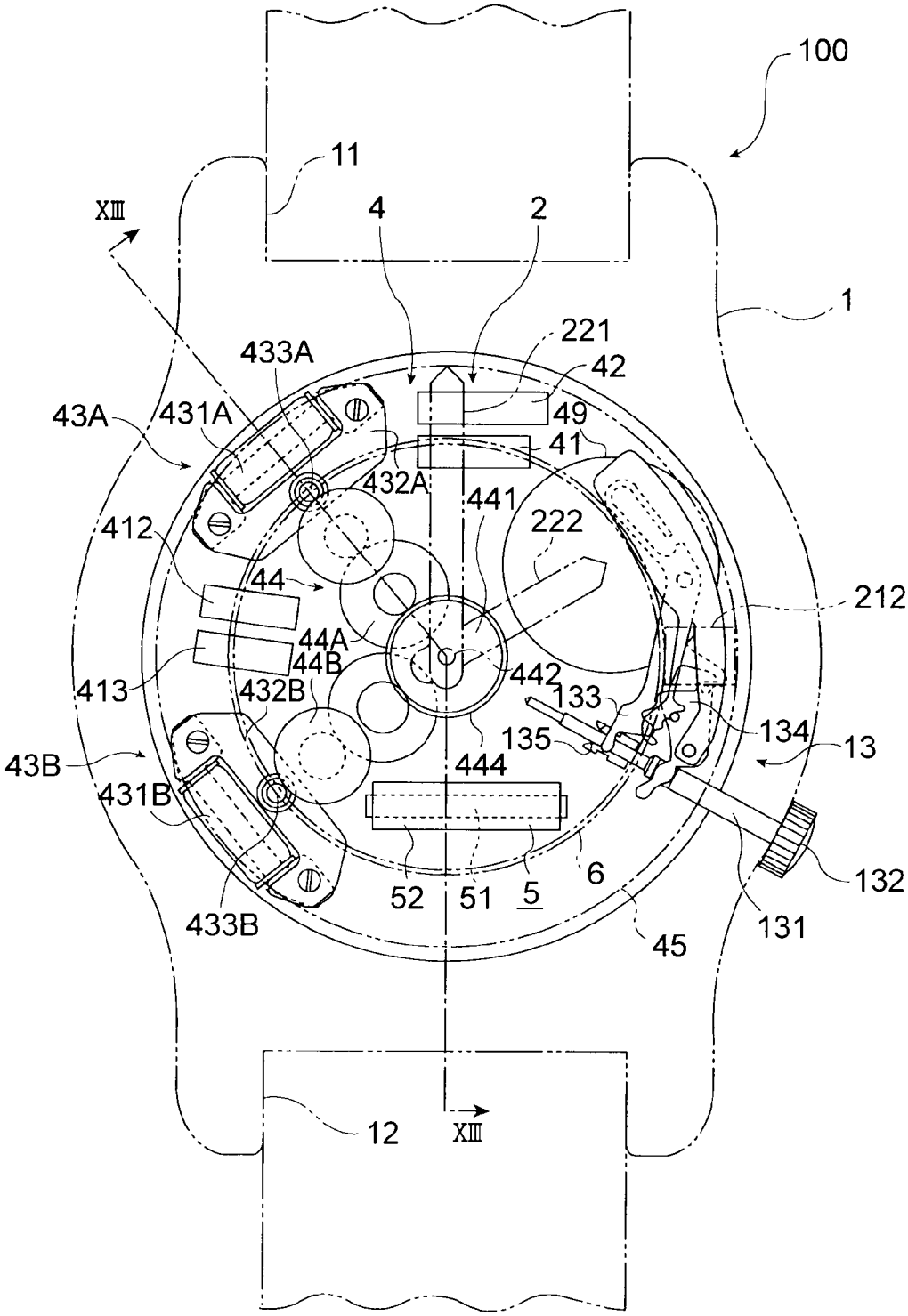
FIG. 12 is a plan view showing another variation of a radio-controlled timepiece according to the present invention.
Figure 13:
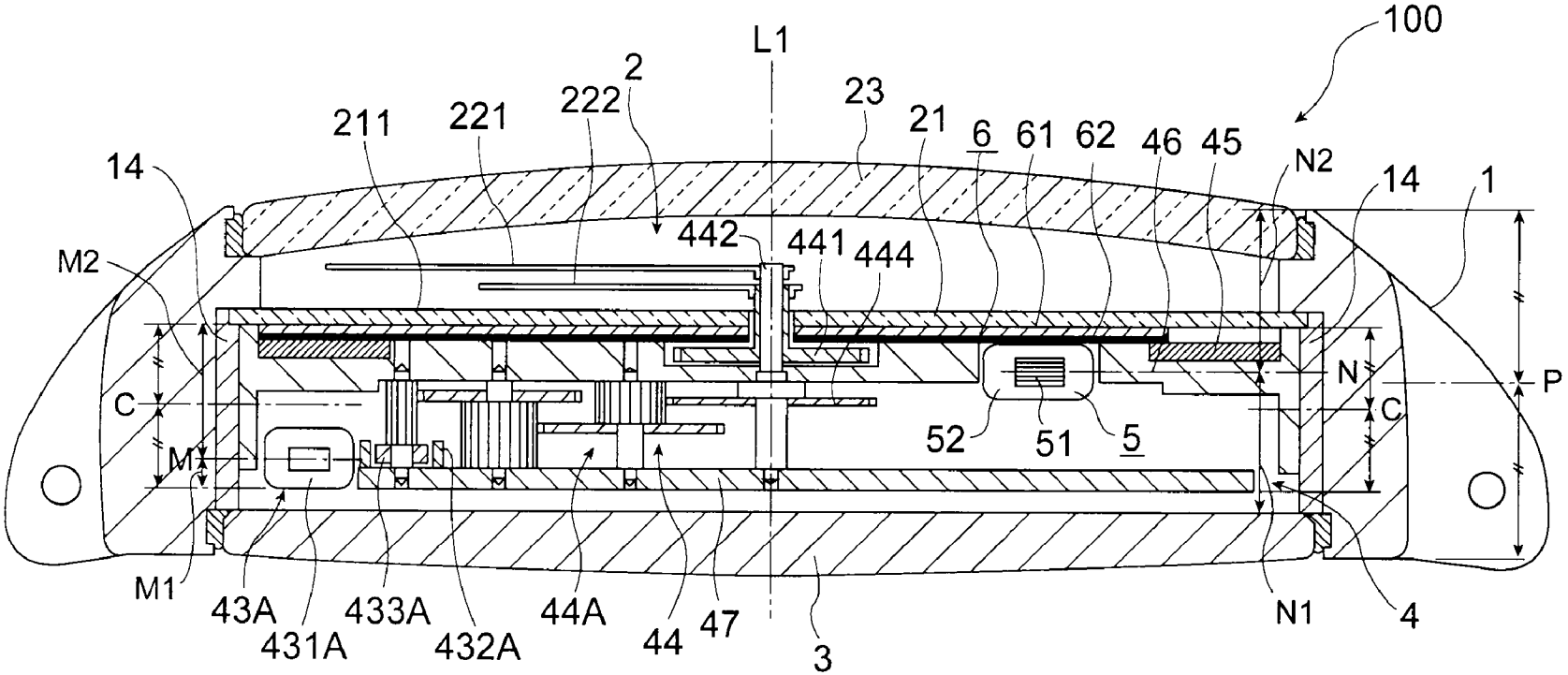
FIG. 13 is a section view through line XIII-XIII in FIG. 12.

FIG. 12 is a plan view showing an alternative embodiment of the invention, and FIG. 13 is a section view through line XIII-XIII in FIG. 12. As shown in FIG. 12 and FIG. 13, a date wheel 45 is rendered between the movement 4 and photoelectric generating means 6 inside the case member 1. The date wheel 45 is a ring-shaped gear with an open center portion, and is made of plastic, inorganic glass, paper, or other nonconductive and nonmagnetic material. The date wheel 45 is meshed with the gear train (not shown in the figure) linked from the center wheel 441, and rotates at a specific speed due to rotation of the center wheel 441. Letters (not shown in the figure) denoting the date are recorded on the date wheel 45 opposite the dial 21. A date window 212 enabling the letters on the date wheel 45 to be read from the outside is opened in the 3:00 direction of the dial 21.

The photoelectric generating means 6 is formed in a circle with a radius that is greater than the radius of the inside circumference of the date wheel 45, and the support substrate 62 covers the top inside circumference portion of the date wheel 45 such that the date wheel 45 is held between the support substrate 62 and movement 4, thus preventing the position of the date wheel to shift in the sectional direction of the date wheel. The photoelectric generating means 6 thus functions as a date wheel presser. Furthermore, the radius of the photoelectric generating means 6 is smaller than the outside circumference radius of the date wheel 45, thereby enabling the ring part of the date wheel 45 to be seen from the dial 21. The support substrate 62 is made of polyimide resin or other nonconductive, nonmagnetic material.

The antenna 5 is located on the inside side of the inside circumference of the date wheel 45 with the antenna axis substantially parallel to a line through 3:00 and 9:00. The antenna 5 and date wheel 45 therefore do not overlap in a plan view of the radio-controlled timepiece 100.

Because the support substrate 62 is made from a nonmagnetic material in this embodiment of a radio-controlled timepiece 100, the antenna 6 can receive signals from the dial 21 with good reception.

Furthermore, because the photoelectric generating means 6 also functions as a date wheel presser, the parts count can be reduced, the thickness of the radio-controlled timepiece 100 can be reduced, and the manufacturing cost can be reduced.

Furthermore, because the antenna 4 and date wheel 45 are rendered so that they do not overlap in a plan view of the radio-controlled timepiece 100, the antenna 5 is afforded good reception performance even if the date wheel 45 is made from a metal material that is both conductive and magnetic.

Figure 14:
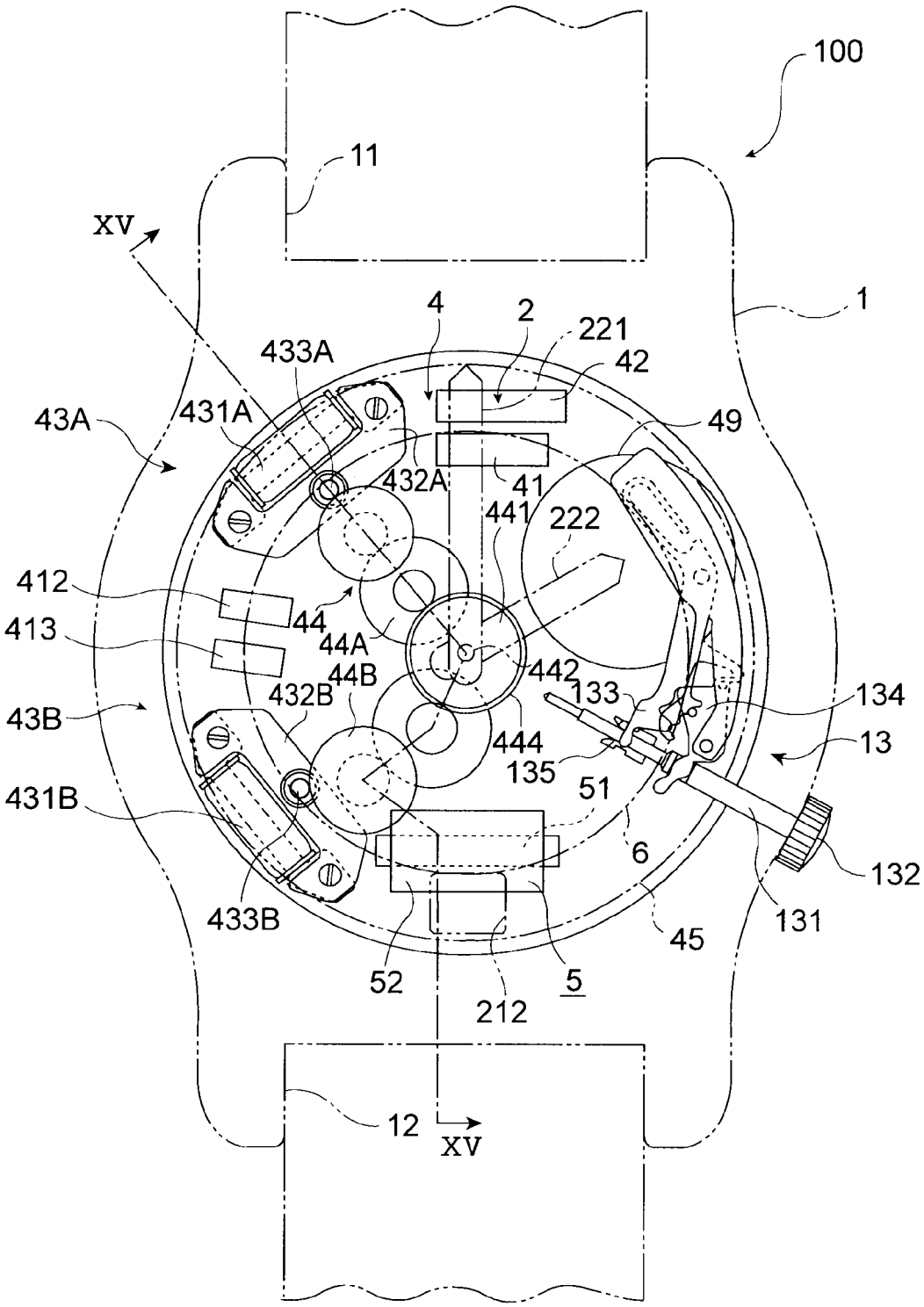
FIG. 14 is a plan viewing showing a variation of the antenna location according to the present invention.
Figure 15:
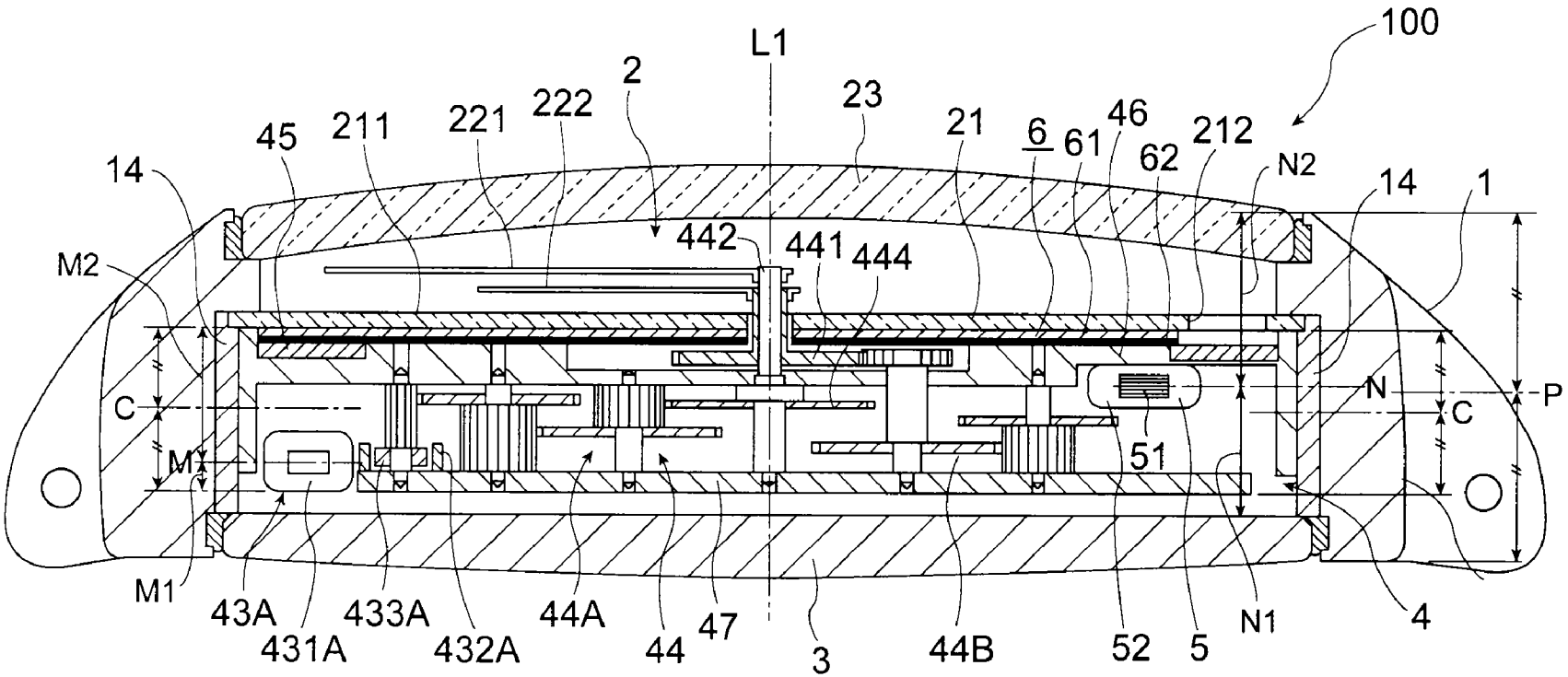
FIG. 15 is a section view through line XV-XV in FIG. 14.

As shown in FIG. 14 and FIG. 15, the antenna 5 could also be located overlapping the date wheel 45 in a plan view of the radio-controlled timepiece 100.

FIG. 14 is a plan view showing an alternative arrangement of an antenna according to the present invention, and FIG. 15 is a section view through line XV-XV in FIG. 14. As shown in FIG. 14 and FIG. 15, in a plan view of the radio-controlled timepiece 100, the antenna 5 is disposed in the 6:00 direction at a position more toward the outside circumference inside the case member 1 when compared with the antenna 5 of the radio-controlled timepiece 100 shown in FIG. 12 and FIG. 13. With this arrangement, part of the antenna 5 overlaps the date wheel 45 when seen in a plan view of the radio-controlled timepiece 100. The date wheel 45 is made of polyacetal resin or other plastic material, and the date window 212 is rendered in the 6:00 direction. Because the antenna 5 is located more on the outside circumference side in the movement 4 with this arrangement, space inside the radio-controlled timepiece 100 can be used efficiently, and greater freedom is afforded in the layout of the other component parts. Furthermore, by locating the antenna 5 on the outside circumference side of a case member 1 that has more internal space, the size of the antenna 5 can be increased and the reception sensitivity of the antenna 5 can be improved.

Furthermore, in FIG. 12, FIG. 13, FIG. 14, and FIG. 15, the center N in the thickness direction (height direction) of the 55 core 51 is on the dial 21 side of the center in the thickness direction (height direction) of the movement 4. In addition, the center N in the thickness direction (height direction) of the core 51 is located on the dial 21 side of the center P in the thickness direction of the case member 1. The distance N2 from the center N in the thickness direction of the core 51 (antenna 5) to the edge of the case member 1 on the side opposite the back cover 3 is also less than the distance N1 from the center N in the thickness direction of the core 51 (antenna 5) to the back cover 3. By thus disposing the antenna 5, the antenna 5 can receive signals from the dial 21 side opening in the case member 1 with good reception. As shown in FIG. 10 and FIG. 11, the hour hand gear train 44B and other parts of the movement 4 can be disposed between the antenna 5 and gear train holder 47.

The shape and configuration of the antenna shall not be limited to the embodiments described above, and can be determined appropriately with consideration for the reception performance of the antenna and the space available in the case member. The antenna could, for example, be a so-called coreless antenna having a hollow center and no core. The antenna core shall also not be limited to a laminated assembly of multiple foil layers, and could be a round or square rod.

The antenna shall also not be limited to an assembly with the main plate, and could, for example, be mounted on a circuit board.

Figure 16:
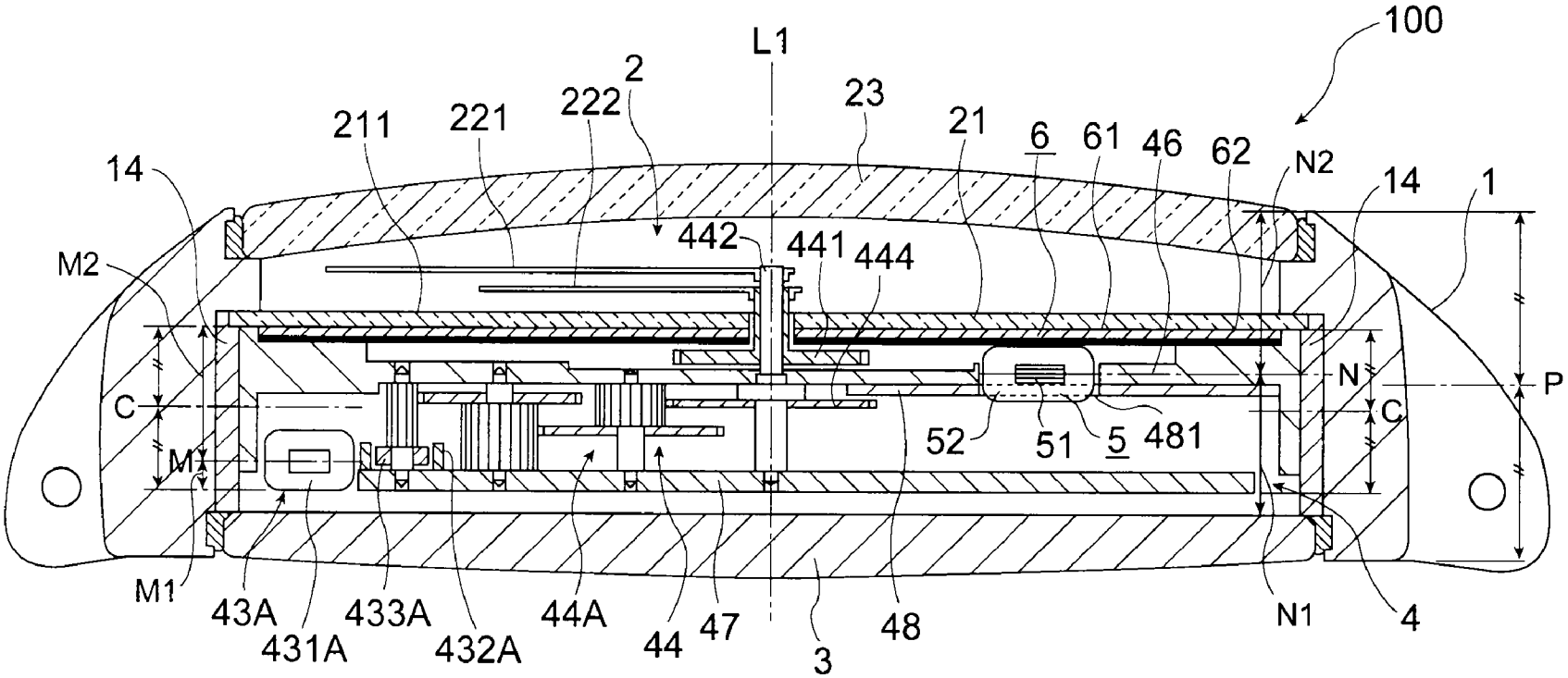
FIG. 16 is a side section view showing a variation of the structure for affixing the antenna in the present invention.
Figure 17:
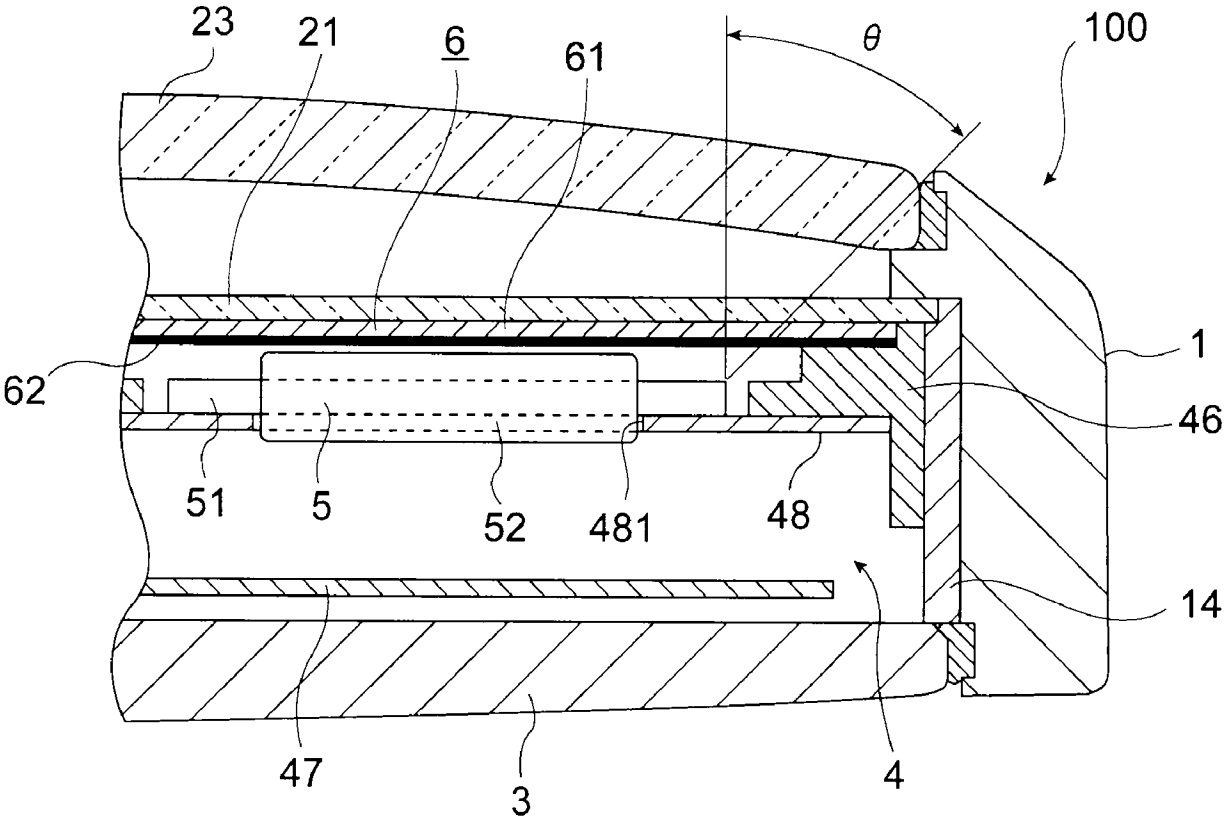
FIG. 17 is a partial side section view showing a variation of the structure for affixing the antenna in the present invention.

FIG. 16 is a side section view showing a variation of the structure for affixing the antenna in the present invention, and FIG. 17 is an enlargement of the side view in FIG. 16. As shown in FIG. 16 and FIG. 17, a circuit board 48 on which the quartz oscillator unit 41 and circuit block 42 are mounted is disposed in the movement 4. The circuit board 48 is located in contact with the bottom side of the main plate 46 (the side opposite the gear train holder 47), and is fastened by screw to the main plate 46. An aperture 481 is formed in the circuit board 48 at a position corresponding to the location of the antenna 5; the coil 52 of the antenna 5 is located inside this aperture 481, and the core 51 contacts the circuit board 48. The core 51 is fastened to the circuit board 48 by soldering, adhesion, riveting, or other method. Because the antenna 5 is securely fixed to the circuit board 48 as a result of this method of fastening the antenna 5, the antenna 5 will not move inside the movement 4 as a result of moving the radio-controlled timepiece 100, and breaks in the coil 52 and interference with other component parts can be reliably prevented. Note that as shown in FIG. 17 the angle q between the line from the end of the antenna 5 to the top edge portion on the inside of the case member 1, and the cylindrical axis L1 of the case member 1, is preferably 45° or more as this arrangement enables external signals to efficiently reach the core 51 of the antenna 5 and thus affords good reception even when the case member 1 is metal, for example.

The antenna could also be shaped with the antenna core bent toward one edge portion of the case member.

Figure 18:
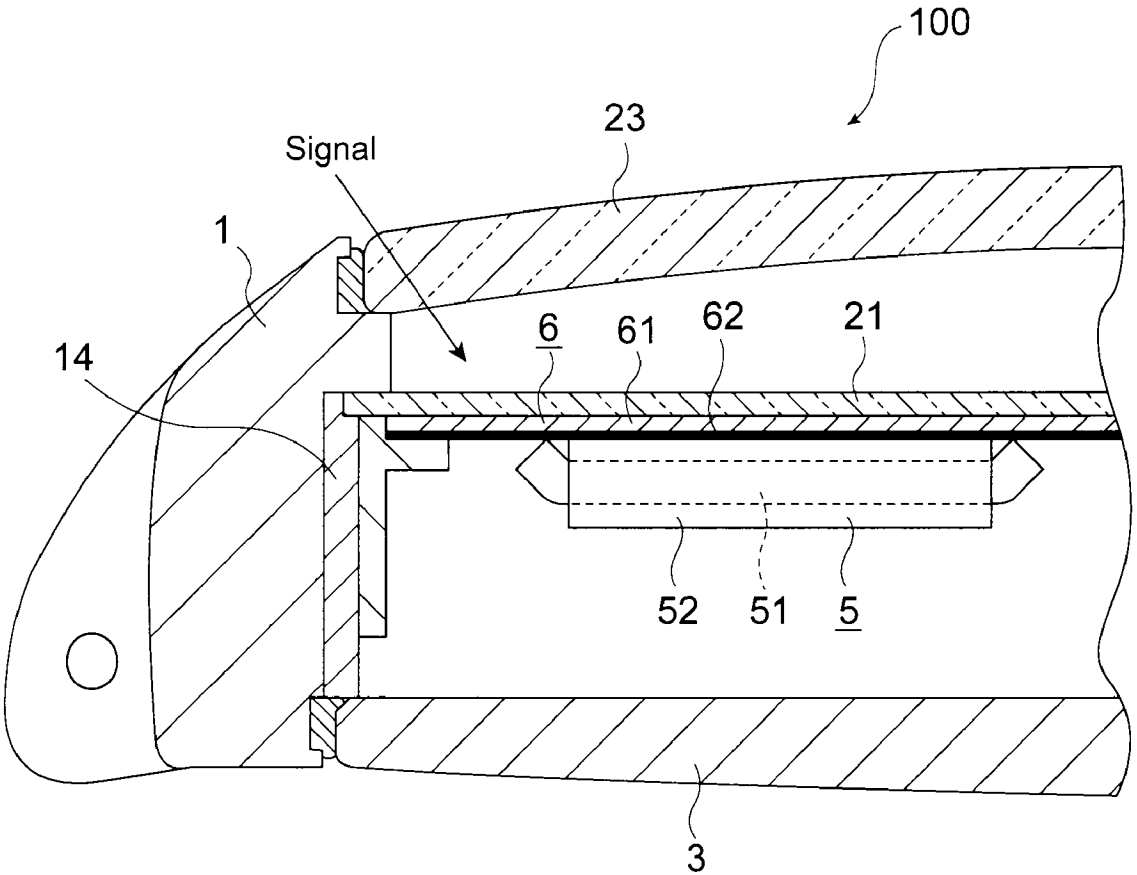
FIG. 18 is a partial side section view showing a variation of the structure for affixing the antenna in the present invention.
Figure 19:
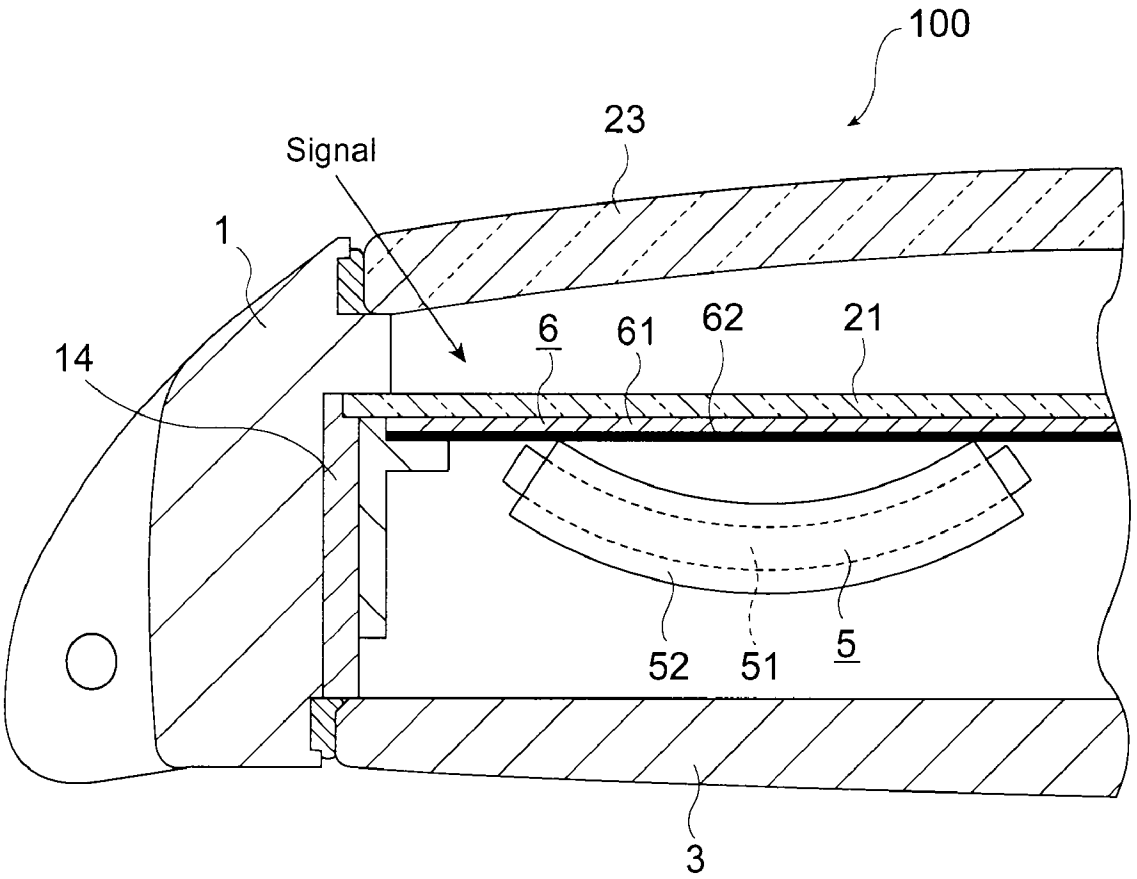
FIG. 19 is a partial side section view showing another variation of the structure for affixing the antenna in the present invention.

FIG. 18 and FIG. 19 show variations of the shape of an antenna in the present invention. In the variation shown in FIG. 18, the core 51 of the antenna 5 is bent toward the dial 21 at both ends of the coil 52 and is thus inclined toward the opening on the crystal 23 side of the metal case member 1. In the variation shown in FIG. 19, both the core 51 and coil 52 are curved such that the entire antenna 5 is curved toward the dial 21, and the ends of the core 51 are thus located closer than the coil 52 to the dial 21. The bending angle or angle of curvature are preferably set so that a line extended from the ends of the antenna 5 passes through the opening in the case in which the crystal 23 is located without intersecting the metal case member 1.

If at least one of the two ends of the antenna 5 is thus bent or curved towards one opening in the case member, signals entering from the opening in the case member 1 can easily enter the core 51 of the antenna 5, and good signal reception can thus be achieved.

Furthermore, because signal reception performance can be improved by thus curving the antenna towards one opening in the case, the antenna can be assured of good signal reception even if the case member is small. This arrangement thus facilitates reducing the size of the case and affords a greater variety of designs.

Regarding the relative plan view positions of the antenna and photoelectric generating means, the entire antenna 5 overlaps the photoelectric generating means 6 in a plan view of the radio-controlled timepiece 100 in the first embodiment, and in the second embodiment the antenna 5 and photoelectric generating means 6 are positioned so that they do not overlap in a plan view of the radio-controlled timepiece 100. The invention shall not be so limited, however, and the antenna could be positioned with part of the antenna overlapping the support substrate of the photoelectric generating means.

Figure 20:
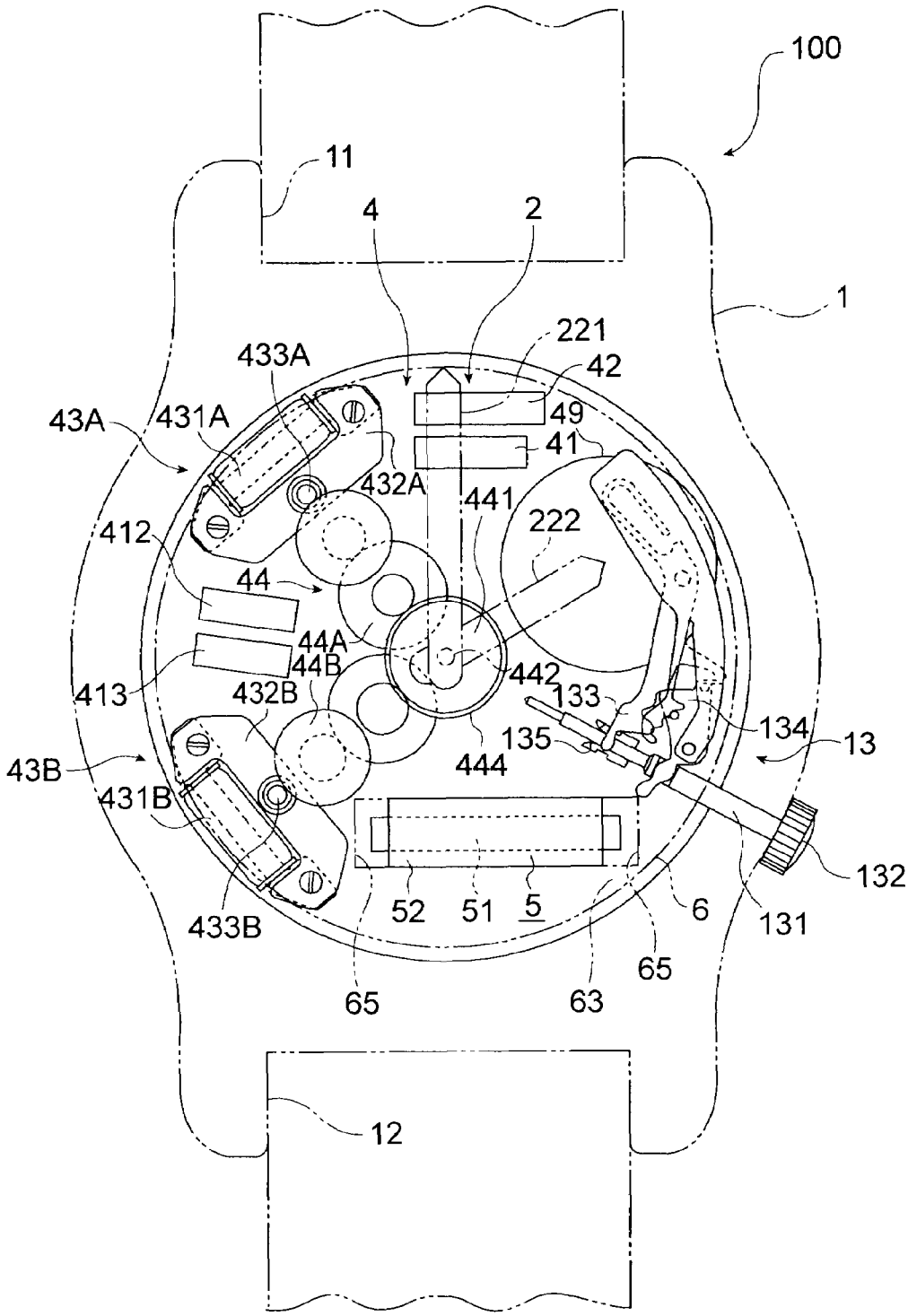
FIG. 20 is a plan view showing a variation of the arrangement of the antenna and photoelectric generating means of the present invention.
Figure 21:
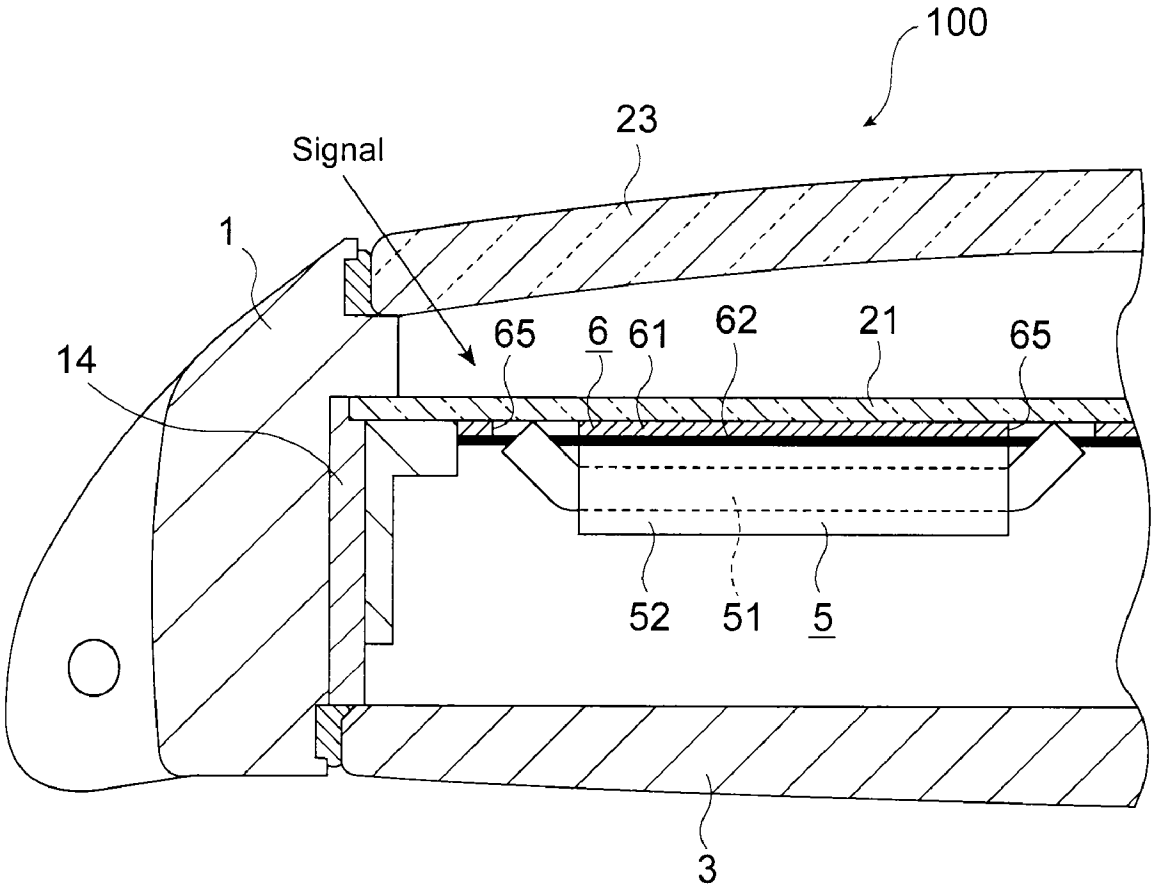
FIG. 21 is a partial side section view of FIG. 20.

FIG. 20 is a plan view showing an alternative arrangement of the antenna and photoelectric generating means, and FIG. 21 is a partial section view of FIG. 20. As shown in FIG. 20 and FIG. 21, an open portion 65 is formed in the photoelectric generating means 6 at the position corresponding to the core 51 portion at both ends of the antenna 5. In a plan view of the radio-controlled timepiece 100, the ends of the antenna 5 in this arrangement do not overlap the support substrate 62. External signals can therefore pass through this open portion 65 and reach the antenna 5 even if the support substrate 62 is made of stainless steel or other metal, and signals can be received with good reception. Of course, if the support substrate 62 is made of polyimide or other nonmetallic material, the antenna 5 can receive signals even more dependably. Furthermore, because open portions 65 are formed in the photoelectric generating means 6 only at positions corresponding to the end portions of the antenna 5, a large light receiving area can be assured. The antenna 5 is thus assured of good reception sensitivity while the generating efficiency of the photoelectric generating means 6 is also good.

The core 51 at both ends of the antenna 5 can be curved toward the support substrate 62 as shown in FIG. 21 with this arrangement, and this arrangement affords even more reliable signal reception. Because the antenna receives signals as a result of the magnetic field passing through the ends in the axial direction of the coil 52, (both) end portions of the antenna 5 in particular are preferably not covered by a magnetic material. The middle portion of the antenna 5, for example, can therefore be covered by the support substrate. The antenna 5 can still receive signals with good reception when thus disposed because the magnetic field can enter from the ends of the antenna 5. What is important is that the antenna is located so that at least part of the antenna is not covered by the support substrate when seen in a plan view of the radio-controlled timepiece.

Both ends of the antenna are magnetically connected to the support substrate of the photoelectric generating means in the third embodiment, but the invention shall not be so limited. For example, only one of the two ends of the antenna could be magnetically connected to a support substrate made of a high permeability material. More particularly, it is sufficient if at least one of the ends of the antenna is magnetically connected to a support substrate made of a high permeability material.

When the antenna and photoelectric generating means are seen in a side view, the antenna 5 is rendered touching the photoelectric generating means 6 in the first embodiment. The invention shall not be so limited, however, and the relative positions of the antenna 5 and photoelectric generating means 6 can be determined appropriately with consideration for where the component parts of the movement 4 are located and from what materials the components of the radio-controlled timepiece 100 are made. For example, insofar as radio signals can reach both ends of the antenna, the antenna 5 can be located separated from the photoelectric generating means 6 with the gap therebetween maintained to a specific dimension.

In the second embodiment and third embodiment the antenna 5 and photoelectric generating means 6 are rendered in a side view of the radio-controlled timepiece 100 with a portion of the antenna 5 at a position overlapping the photoelectric generating means 6. The invention shall not be so limited, however, and the antenna 5 and photoelectric generating means 6 can be positioned with a specific gap therebetween and not overlapping when seen in a side view.

Regarding the position of the antenna in a side view of the radio-controlled timepiece, the center of the antenna is offset from the center of the case member in proximity to the cover member side. However, when the back cover 3 protrudes to the outside from the bottom edge of the case member 1 as shown in FIG. 2, the center of the antenna may be disposed on the support substrate 62 side (the dial 21 side, crystal 23 side) from the center of the distance from the top edge of the case member 1 to the bottom edge of the back cover 3. Furthermore, when the back cover 3 is shaped curving upward from the bottom edge of the case member 1, the center of the antenna can be set to the support substrate 62 side relative to the center of the distance from the top edge to the bottom edge of the case member 1. That is, the center of the antenna must be positioned on the support substrate side from the center of the case member portion including the case member and back cover, in which case the center of this case member portion is the center of the greatest distance in the thickness direction (along the cylindrical axis of the case member) through the case member and the back cover.

The shape of the antenna is also not limited to configurations that appear straight when seen in a plan view of the radio-controlled timepiece.

Figure 22:
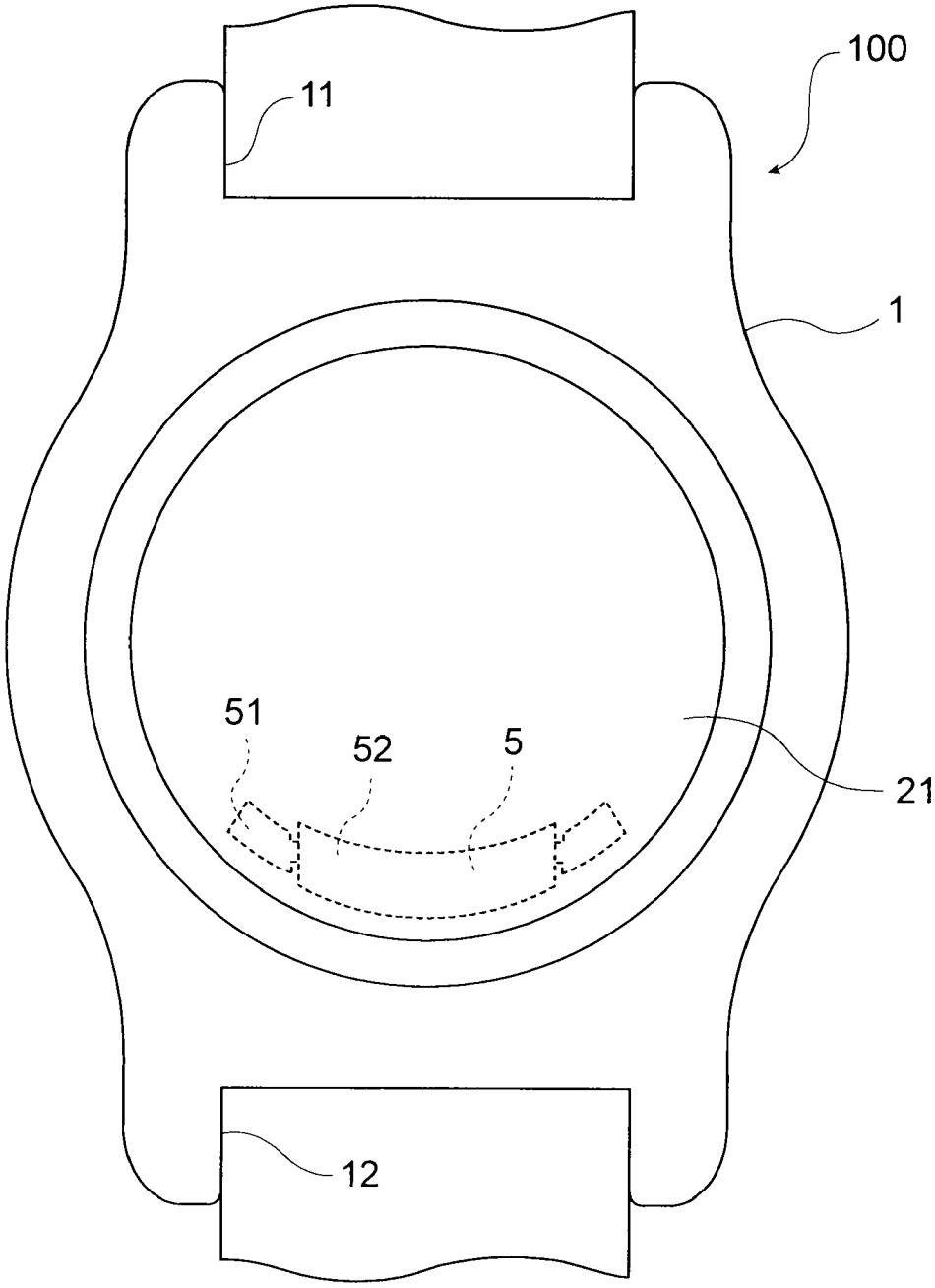
FIG. 22 is a plan view showing a variation of the shape of the antenna according to the present invention.

FIG. 22 is a plan view of an antenna with an alternative shape. As shown in FIG. 22 this antenna 5 is shaped in an arc following the inside shape of the case member 1. The antenna 5 is also disposed along the outside shape of the dial 21, and is located inside this dial 21 in a plan view of the radio-controlled timepiece 100. Compared with rendering the antenna 5 in a straight line, this shape of the antenna 5 reduces the amount of dead space inside the case member 1 and thus affords greater freedom in the layout of other components.

Figure 23:
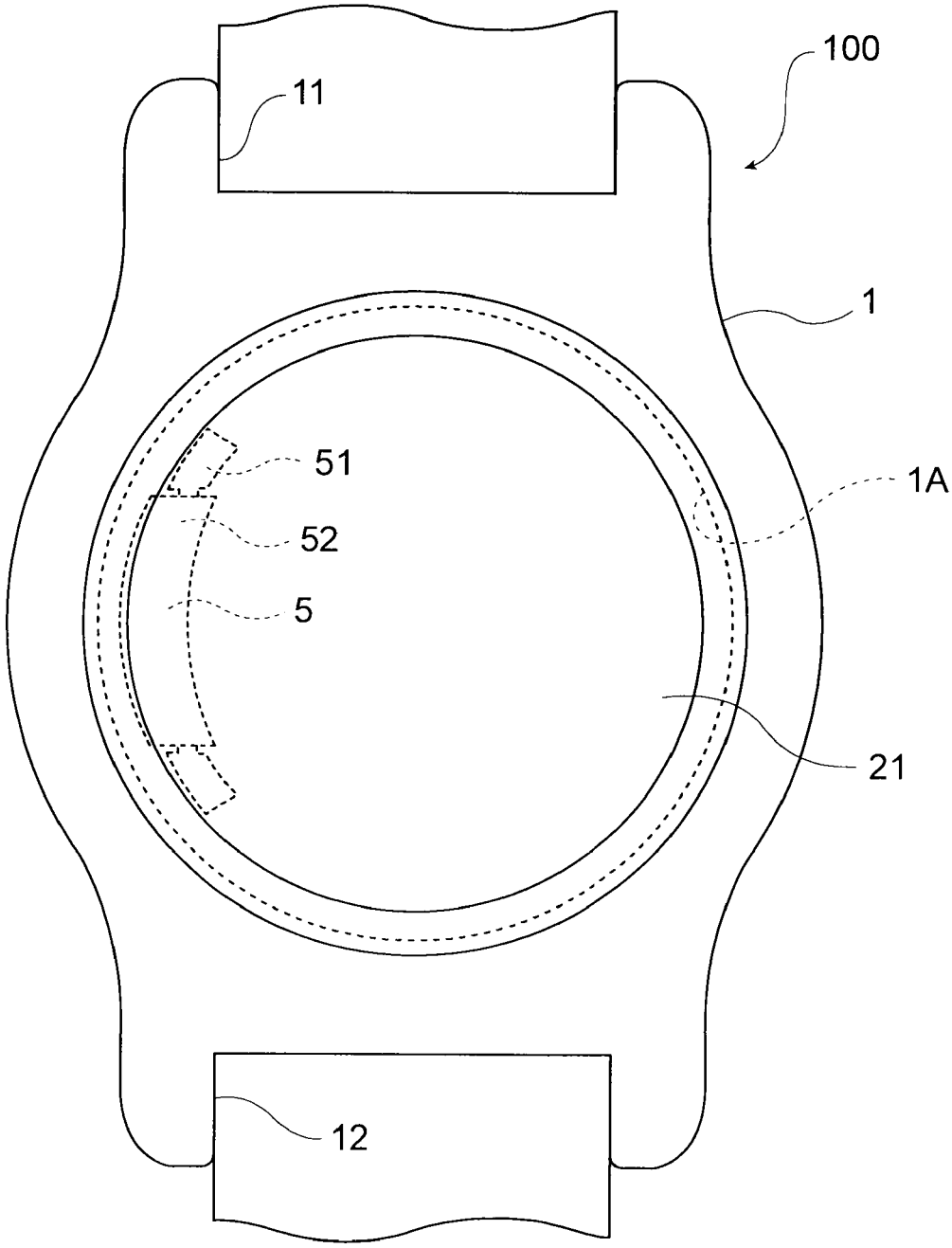
FIG. 23 is a plan view showing another variation of the antenna arrangement according to the present invention.
Figure 24:
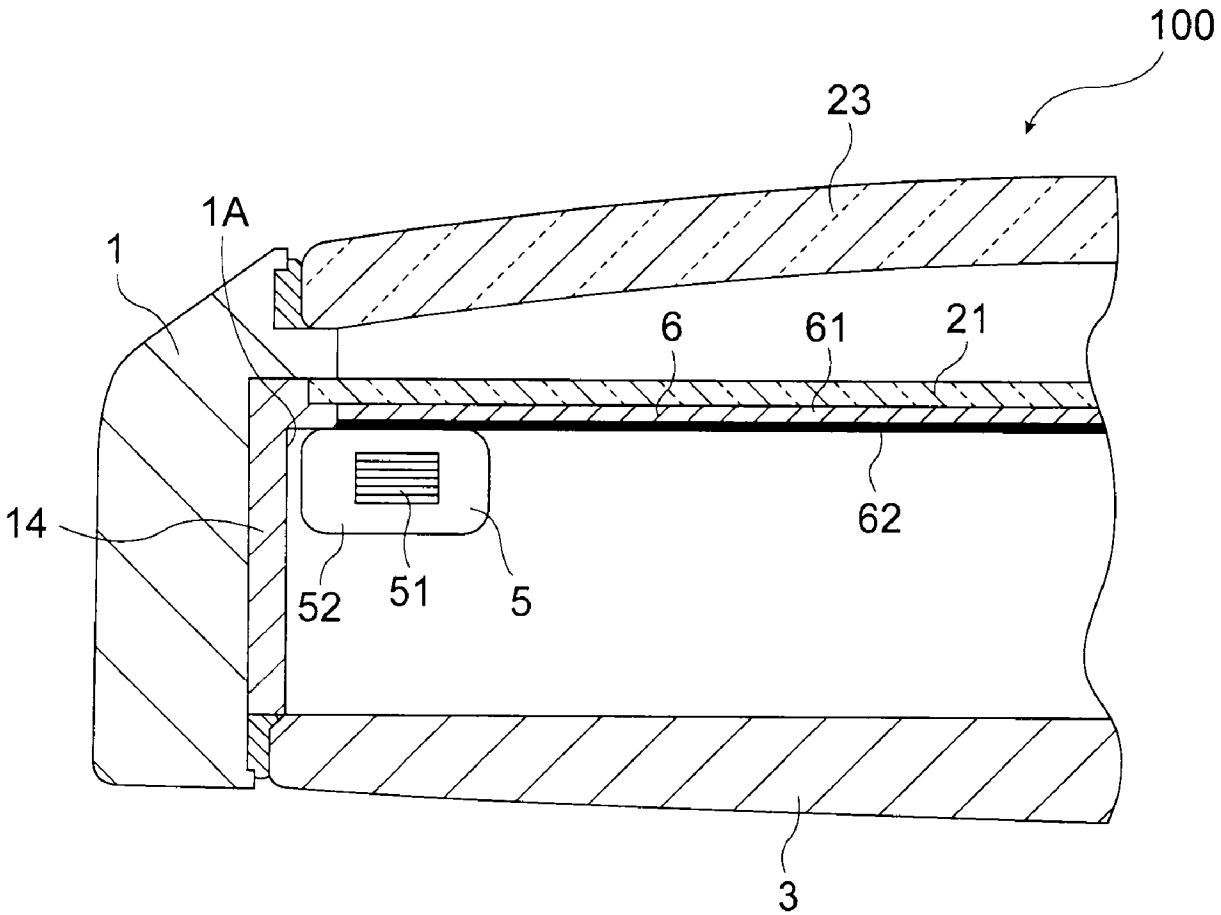
FIG. 24 is a partial side section view of FIG. 23.

FIG. 23 and FIG. 24 show a variation in the location of the antenna, FIG. 23 being a plan view of the radio-controlled timepiece 100 and FIG. 24 being a partial side section view of the radio-controlled timepiece 100 shown in FIG. 23. In FIG. 23 and FIG. 24 the antenna is substantially arc-shaped conforming to the inside of the case member 1, and the outside curve of the antenna 5 is housed within a recess 1A formed in the spacer 14 and case member 1. This results in part of the antenna 5 overlapping the case member 1 in a plan view of the radio-controlled timepiece 100. Note that in this case the area of the portion of the antenna 5 that overlaps the case member 1 (the area in a plan view of the radio-controlled timepiece 100) is preferably less than half of the total area of the antenna 5. This disposition maintains the good reception sensitivity of the antenna 5 while using space inside the case member 1 efficiently and affording even greater freedom in the layout of other components.

The coil of the electromagnetic motors is disposed in proximity to the back cover 3 in these embodiments of the present invention, but the invention shall not be so limited. For example, the center in the thickness direction of the coil could be located on the dial side of the center in the thickness direction of the movement. If the coil and antenna are separated from each other in a plan view of the radio-controlled timepiece, or if signal reception by the antenna is stopped when the motors are operating, the antenna 5 can still receive signals correctly and the object of the invention can be achieved.

In the second and third embodiments the support substrate 62 can be made from a nonconductive and nonmagnetic material such as polyimide resin, glass-impregnated epoxy, or ceramic as in the first embodiment, or it could be made from a conductive, magnetic material such as stainless steel. If the support substrate 62 is made from a nonmagnetic material, however, there is less magnetic material around the antenna 5 and reception by the antenna 5 is thus more reliable.

It is also possible to make only the photoelectric generating means 6A in the third embodiment from a nonconductive and nonmagnetic material.

The switching unit 13 and gear train 44 are disposed between the battery and antenna in the preceding embodiments, but the invention shall not be so limited. The quartz oscillator unit 41 and circuit block 42, for example, could also be located between the battery and antenna. The effect of the metal case member of the battery on the magnetic field around the antenna can thus be minimized. More specifically, it is only necessary to dispose at least one of the switching unit, gear train, quartz oscillation unit, and control unit between the battery and antenna.

It will also be apparent that if such other component is not disposed between the battery and antenna, signal reception by the antenna can be enabled by changing the orientation of the antenna or the material of the battery case, and the object of the present invention can be achieved.

The drive means is also not limited to an electromagnetic motor, and any desirable construction capable of driving the time display means can be used, including, for example, a piezoelectric actuator that operates using the vibrations of a piezoelectric element. In this case a flat piezoelectric element is adhesively bonded to a substantially square reinforcing plate, and a protrusion is formed on the reinforcing plate to form the piezoelectric actuator. A rotor or other rotating body engages the gear train, and the protrusion of the piezoelectric actuator contacts the side of this rotor. When an AC voltage is then applied to the piezoelectric element, the piezoelectric element vibrates, and the repeated pressure of the protrusion tangentially to the rotor causes the rotor to rotate. The gear train then relays this rotary motion to drive the time display means.

A piezoelectric actuator does not produce a magnetic field during operation, this drive means therefore has no effect on the magnetic field around the antenna, and signals can therefore be correctly received by the antenna.

The time display means is also not limited to having both an hour hand and a minute hand, and could have only an hour hand, or only a minute hand. A second hand could also be provided.

The dial can also be rendered with no letters, numbers, or other marks or decoration. The dial itself could also be omitted. If the dial is not provided, the photoelectric generating means could be used as the dial. In this case the photoelectric generating means uses a transparent material such as inorganic glass for the support substrate to form the dial, and the photoelectric conversion unit is rendered on the cover member side of this support substrate. The cover-side surface of this dial and support substrate could also be decorated with letters, markings, or a pattern, for example. If the antenna is located opposite or proximally to the surface on the cover member side of the photoelectric conversion unit in this configuration, the antenna can receive signals with good reception from the opening on one side of the case member, that is, from the photoelectric generating means side.

The material of the gear train can be desirably determined with consideration for the location of the antenna and the transfer power, and materials such as stainless steel that are conductive and magnetic, or materials that are nonconductive and nonmagnetic such as plastic or ceramic, could be used.

Figure 25:
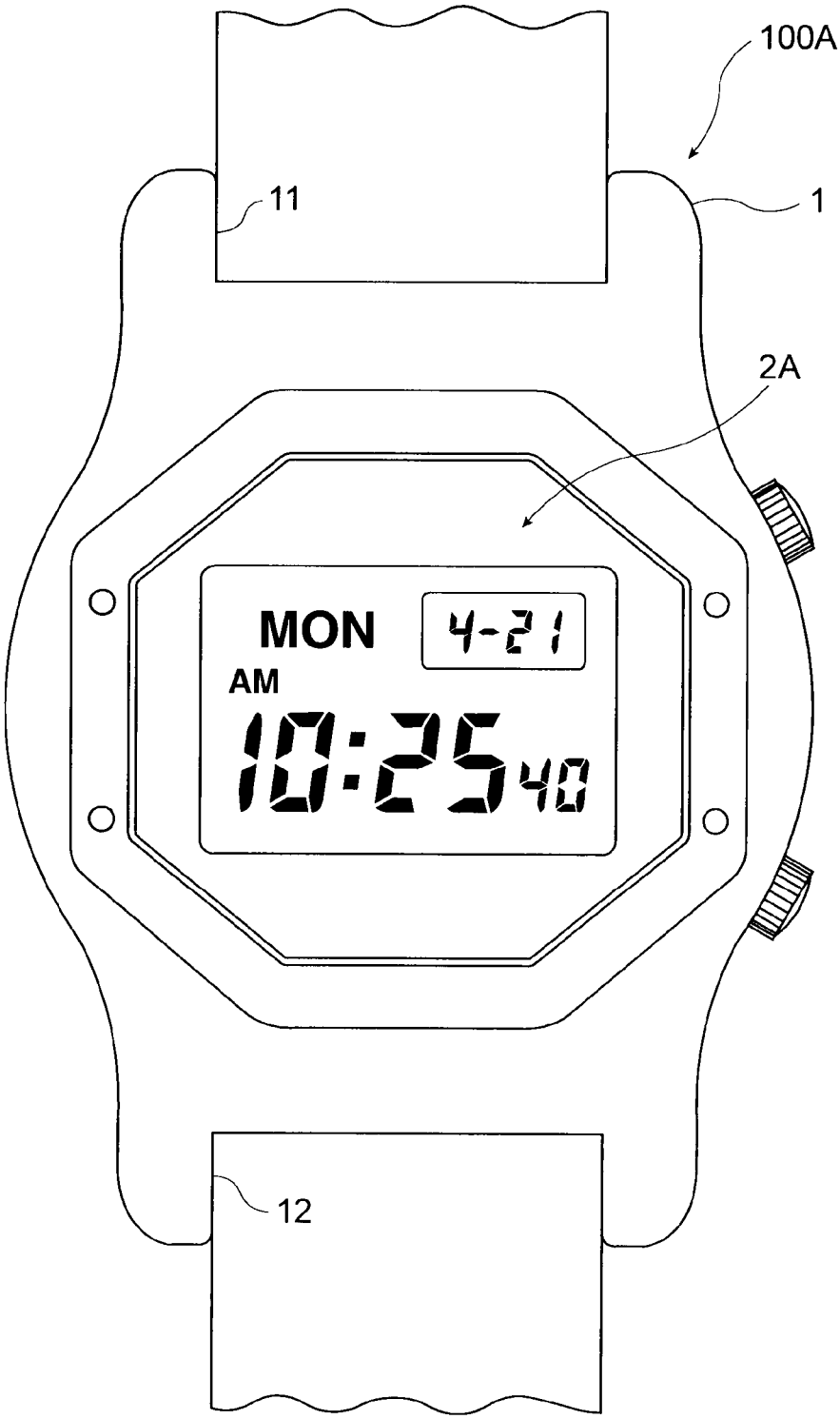
FIG. 25 shows a variation of an electronic timepiece with a radio communication function according to the present invention.

An electronic timepiece with a radio communication function shall also not be limited to analog timepieces having a dial and hands, and as shown in FIG. 25, for example, could be a digital watch 100A having a liquid crystal panel 2A as the time display means for digitally indicating the time, and a parting member 2B. The electronic timepiece with a radio communication function could also have, in addition to the time display function of the time display means, a chronograph function or alarm function, for example.

An electronic timepiece with a radio communication function shall also not be limited to a radio-controlled timepiece that receives an external standard time signal and adjusts the displayed time, and could be a timepiece having a function for externally transmitting radio frequency information, or a function for both receiving and sending radio frequency information. For example, the electronic timepiece with a radio communication function could be a watch having an internal contactless IC card for communicating RF information with an external device via the antenna (contactless data communication).

While the various embodiments including a best mode of the present invention have been described in conjunction with the accompanying figures, the invention shall not be so limited. Specific descriptions of shapes, materials, and other aspects of the invention in the foregoing embodiments are offered herein simply by way of example to facilitate understanding the present invention, not to limit the invention. Various modifications to the shape, materials, quantities, and other details of the foregoing embodiments will be apparent to one with ordinary skill in the related art in light of the foregoing description. The present invention is intended to embrace all such modifications as may fall within the spirit and scope of the appended claims.

What is claimed is:

1. An electronic timepiece having a radio communication function, comprising:

a case member, and a back cover integrated with, or attached to, the case member, the case member and the back cover made of metal or alloy, the case member with which the back cover has been integrated or to which the back cover has been attached defining an interior and having an open end;

an antenna housed in the interior;

a time display unit having a dial and a hand and configured to display the time, the dial being housed in the interior; and an electromagnetic motor housed in the interior and configured to drive the hand of the time display unit;

wherein the dial has a first face that faces toward the open end and a second face that faces toward the back cover;

wherein the antenna is disposed between the second face and the back cover; and wherein, with respect to an axial direction of the case member extending between the open end and the back cover, a distance between a center of the antenna and the open end is less than a distance between a center of the electromagnetic motor and the open end.

2. An electronic timepiece having a radio communication function as described in claim 1, wherein the center of the antenna is the center of the antenna core, the core being made of metal or alloy.

3. An electronic timepiece having a radio communication function as described in claim 2, wherein the center of the electromagnetic motor is the center of a coil of the electromagnetic motor.

4. An electronic timepiece having a radio communication function as described in claim 1, wherein, with respect to the axial direction of the case member extending between the open end and the back cover, a distance between the center of the antenna and the dial is less than a distance between a center of the electromagnetic motor and the dial.

5. An electronic timepiece having a radio communication function as described in claim 1, wherein the dial is made of a nonconductive and nonmagnetic material.

6. An electronic timepiece having a radio communication function as described in claim 5, further comprising a photoelectric generator, the photoelectric generator being disposed on, or proximally to, a side of the dial facing in a direction of the back cover.

7. An electronic timepiece having a radio communication function as described in claim 1, wherein an outer surface of the case member or the back cover comprises molded synthetic resin that is coated with a thin metallic film.

8. An electronic timepiece having a radio communication function as described in claim 1, further comprising a movement and wherein the antenna is part of the movement.

9. An electronic timepiece having a radio communication function as described in claim 1, wherein the open end includes a top surface portion of the case member.

10. An electronic timepiece having a radio communication function as described in claim 1, further comprising a movement housed in the interior, the movement including the electromagnetic motor.

11. An electronic timepiece having a radio communication function as described in claim 10, wherein, with respect to the axial direction of the case member extending between the open end and the back cover, a distance between the center of the electromagnetic motor and the back cover is less than a distance between a center of the movement and the back cover.

12. An electronic timepiece having a radio communication function as described in claim 10, wherein, with respect to the axial direction of the case member extending between the open end and the back cover, a center of the movement is positioned between the center of the antenna and the center of the electromagnetic motor.

13. An electronic timepiece having a radio communication function, comprising:

a case member, and a back cover integrated with, or attached to, the case member, the case member and the back cover made of metal or alloy, the case member with which the back cover has been integrated or to which the back cover has been attached defining an interior and having an open end;

an antenna housed in the interior, the antenna including a core made of high permeability material and a coil; and a time display unit configured to display the time and housed in the interior;

wherein, with respect to an axial direction of the case member extending between the open end and the back cover, a distance between a center point of at least one continuous end surface segment of the core of the antenna and the time display unit is less than a distance between a center of the coil and the time display unit.

14. An electronic timepiece with a radio communication function as described in claim 13, wherein the coil of the antenna is wound around the core, and at least one end of the antenna is bent toward the time display unit.

15. An electronic timepiece with a radio communication function as described in claim 13, wherein the time display unit includes a dial.

16. An electronic timepiece with a radio communication function as described in claim 15, further comprising a photoelectric generator, the photoelectric generator being disposed on, or proximally to, a side of the dial facing in a direction of the back cover.

17. An electronic timepiece having a radio communication function as described in claim 15, wherein the dial is made of a nonconductive and nonmagnetic material.

18. An electronic timepiece having a radio communication function as the distance determinations with respect to the time display unit are with respect to the dial of the time display unit distance between a center of the coil and the time display unit is the distance between a center of the coil and the dial.

19. An electronic timepiece with a radio communication function as described in claim 13, further comprising a movement housed in the interior, the movement including an electromagnetic motor configured to drive the time display unit, wherein, with respect to the axial direction of the case member extending between the open end and the back cover, a distance between a center of the antenna and the time display unit is less than a distance between a center of the electromagnetic motor and the time display unit.

20. An electronic timepiece having a radio communication function as described in claim 13, wherein an outer surface of the case member or the back cover comprises molded synthetic resin that is coated with a thin metallic film.

21. An electronic timepiece having a radio communication function as described in claim 13, wherein the time display unit includes a liquid crystal panel.

22. An electronic timepiece having a radio communication function, comprising:

a case member, and a back cover integrated with, or attached to, the case member, the case member and the back cover made of metal or alloy, the case member with which the back cover has been integrated or to which the back cover has been attached defining an interior and having an open end;

an antenna housed in the interior;

a photoelectric generator disposed in the interior, the photoelectric generator having a support substrate made of a nonconductive and nonmagnetic material and a photoelectric conversion element that is supported on, or proximally to, the support substrate to receive light, the photoelectric conversion element being configured to generate electricity from the received light;

a time display unit configured to display the time; and a drive unit;

wherein the antenna is disposed on or under the photoelectric generator or proximally thereto between the photoelectric generator and the back cover, with an axis of the antenna being substantially parallel to the plane of the support substrate, such that the antenna is in a position overlapping the support substrate relative to a plan view of the electronic timepiece.

23. An electronic timepiece having a radio communication function as described in claim 22, wherein the antenna is disposed between the photoelectric generator and the back cover at a specified distance from the photoelectric generator.

24. An electronic timepiece having a radio communication function as described in claim 22, further comprising a cover member that covers the open end of the case member, and a dial of the time display unit disposed between the photoelectric generator and the cover member, both the cover member and the dial being made of a nonconductive and nonmagnetic material.

25. An electronic timepiece having a radio communication function as described in claim 22, wherein no other component of the electronic timepiece is disposed between the antenna and the photoelectric generator relative to a side view of the electronic timepiece.

26. An electronic timepiece having a radio communication function as described in claim 22, wherein at least one other component of the electronic timepiece is disposed between the antenna and the back cover relative to a side view of the electronic timepiece.

27. An electronic timepiece having a radio communication function as described in claim 22, further comprising a movement housed in the interior, the movement including the drive unit, the movement having a height in a direction of the electronic timepiece extending between the open end and the back cover and a center in the height direction, wherein a center of a core of the antenna is positioned on the open end side of the center of the movement in the height direction.

28. An electronic timepiece having a radio communication function as described in claim 22, further comprising a date wheel made of a nonconductive and nonmagnetic material, the date wheel having a back cover side that faces in the direction of the back cover, wherein the antenna is disposed proximally to the back cover side between the back cover side and the back cover, such that the antenna overlaps both the support substrate and the date wheel relative to a plan view of the electronic timepiece.

29. An electronic timepiece having a radio communication function as described in claim 22, wherein an outer surface of the case member comprises molded synthetic resin that is coated with a thin film having metallic properties.

30. An electronic timepiece having a radio communication function as described in claim 22, wherein, with respect to an axial direction of the case member extending between the open end and the back cover, a distance between the antenna and the photoelectric generator is less than a distance between the antenna and the back cover.

31. An electronic timepiece having a radio communication function as described in claim 30, wherein the distance measurements are between a center of the antenna and the photoelectric generator and between the center of the antenna and the back cover.

32. An electronic timepiece having a radio communication function as described in claim 31, wherein the distance measurements are between a center of a core of the antenna and the photoelectric generator and between the center of a core of the antenna and the back cover.

33. An electronic timepiece having a radio communication function, comprising:

a case member, and a back cover integrated with, or attached to, the case member, the case member and the back cover made of metal or alloy, the case member with which the back cover has been integrated or to which the back cover has been attached defining an interior and having an open end;

an antenna housed in the interior, the antenna having two ends;

a photoelectric generator disposed in the interior, the photoelectric generator having a support substrate and a photoelectric conversion element that is supported on, or proximally to, the support substrate to receive light, the photoelectric conversion element being configured to generate electricity from the received light;

a time display unit configured to display the time; and a drive unit;

wherein the antenna is disposed on or under the photoelectric generator or proximally thereto between the photoelectric generator and the back cover, with an axis of the antenna being substantially parallel to the plane of the support substrate, with at least both ends of the antenna in positions not overlapping the support substrate relative to a plan view of the electronic timepiece.

34. An electronic timepiece having a radio communication function as described in claim 33, wherein the antenna is disposed between the photoelectric generator and the back cover at a specified distance from the photoelectric generator.

35. An electronic timepiece with a radio communication function as described in claim 33, wherein the antenna and the photoelectric generator are disposed such that at least portions thereof overlap relative to a side view of the electronic timepiece.

36. An electronic timepiece having a radio communication function as described in claim 33, further comprising a cover member that covers the open end of the case member, and a dial of the time display unit disposed between the photoelectric generator and the cover member, both the cover member and the dial being made of a nonconductive and nonmagnetic material.

37. An electronic timepiece having a radio communication function as described in claim 33, wherein no other component of the electronic timepiece is disposed between the antenna and the photoelectric generator relative to a side view of the electronic timepiece.

38. An electronic timepiece having a radio communication function as described in claim 33, wherein no other component of the electronic timepiece is disposed between the antenna and a dial of the time display unit relative to a side view of the electronic timepiece.

39. An electronic timepiece having a radio communication function as described in claim 33, wherein at least one other component of the electronic timepiece is disposed between the antenna and the back cover relative to a side view of the electronic timepiece.

40. An electronic timepiece having a radio communication function as described in claim 33, further comprising a movement housed in the interior, the movement including the drive unit, the movement having a height in a direction of the electronic timepiece extending between the open end and the back cover and a center in the height direction, wherein a center of a core of the antenna is positioned on the open end side of the center of the movement in the height direction of the electronic timepiece.

41. An electronic timepiece having a radio communication function as described in claim 33, further comprising a date wheel made of a nonconductive and nonmagnetic material, the date wheel having a back cover side that faces in a direction of the back cover, wherein the antenna is disposed proximally to the back cover side between the back cover side and the back cover and overlaps the date wheel relative to a plan view of the electronic timepiece.

42. An electronic timepiece having a radio communication function as described in claim 33, wherein an outer surface of the case member comprises molded synthetic resin that is coated with a thin film having metallic properties.

* * * * *

UNITED STATES PATENT AND TRADEMARK OFFICE

CERTIFICATE OF CORRECTION

PATENT NO. : 7,396,155 B2
APPLICATION NO. : 11/457439
DATED : July 8, 2008
INVENTOR(S) : Isao Oguchi It is certified that error appears in the above-identified patent and that said Letters Patent is hereby corrected as shown below:

Column 25

Claim 18, Line 30, after "as" insert --described in claim 15, wherein--

Line 32 after "unit" delete "distance between a center of the coil and the time display unit is the distance between a center of the coil and the dial"

Signed and Sealed this

Twenty-seventh Day of October, 2009

David J. Kappos

David J. Kappos
*Director of the United States Patent and Trademark Office*